US006174641B1

(12) United States Patent
Nakamura et al.

(10) Patent No.: US 6,174,641 B1
(45) Date of Patent: Jan. 16, 2001

(54) NON-MAGNETIC TONER FOR DEVELOPING ELECTROSTATIC LATENT IMAGE

(75) Inventors: Minoru Nakamura, Takarazuka; Katsunori Kurose, Amagasaki; Masahiro Anno, Sakai; Chikara Tsutsui, Nishinomiya; Hiroyuki Fukuda, Sanda, all of (JP)

(73) Assignee: Minolta Co., Ltd., Osaka (JP)

( * ) Notice: Under 35 U.S.C. 154(b), the term of this patent shall be extended for 0 days.

(21) Appl. No.: 09/547,924

(22) Filed: Apr. 11, 2000

Related U.S. Application Data

(62) Division of application No. 09/289,948, filed on Apr. 13, 1999, now Pat. No. 6,063,537.

(30) Foreign Application Priority Data

Apr. 15, 1998 (JP) ..... 10-4425
Mar. 15, 1999 (JP) ..... 068490

(51) Int. Cl.[7] ..... G03G 9/08; G03G 9/097
(52) U.S. Cl. ..... 430/137
(58) Field of Search ..... 430/137

(56) References Cited

U.S. PATENT DOCUMENTS 3,586,654 * 6/1971 Lerman et al. ..... 430/137
4,996,126 2/1991 Anno et al. ..... 430/106.6
5,063,133 11/1991 Kubo et al. ..... 430/111
5,066,558 11/1991 Hikake et al. ..... 430/109
5,206,109 4/1993 Anno ..... 430/137
5,350,657 9/1994 Anno et al. ..... 430/111
5,368,972 * 11/1994 Yamashita et al. ..... 430/137
5,464,722 * 11/1995 Tomiyama et al. ..... 430/137
5,804,351 9/1998 Takano et al. ..... 430/110
5,849,456 * 12/1998 Matsumura et al. ..... 430/137

FOREIGN PATENT DOCUMENTS 3-168760 * 8/1987 (JP) ..... 430/137
62-184469 * 8/1987 (JP) ..... 430/137
63319037 12/1988 (JP) .
01257857 10/1989 (JP) .
04226476 8/1992 (JP) .
06317928 11/1994 (JP) .
06317933 11/1994 (JP) .
9-258474 3/1997 (JP) .

* cited by examiner

*Primary Examiner*—Roland Martin
(74) *Attorney, Agent, or Firm*—McDermott, Will & Emery

(57) ABSTRACT

The present invention relates to a non-magnetic toner for developing electrostatic latent images, having;

an average degree of roundness of not less than 0.960, a standard deviation of degree of roundness of not more than 0.040, a value of $D/d_{50}$ of not less than 0.40, in which $D=6/(\rho \cdot S)$ ($\rho$ is a true density of toner ($g/cm^3$), and S is a BET specific surface area of toner ($m^2/g$)); $d_{50}$ is an average weight particle size of toner, and an adhesive stress of 6 $g/cm^2$ or less under a compression of 1 $kg/cm^2$. The non-magnetic toner for developing electrostatic latent images provides high-quality images not only in low-speed areas, but also in high-speed areas, and has a superior transferring properties.

20 Claims, 3 Drawing Sheets

NON-MAGNETIC TONER FOR DEVELOPING ELECTROSTATIC LATENT IMAGE

This application is a Divisional of application Ser. No. 09/289,948 filed Apr. 13, 1999, now U.S. Pat. No. 6,063,537. This application is based on applications No.Hei 10-104425 and Hei 11-068490 filed in Japan, the contents of which are hereby incorporated by reference.

BACKGROUND OF THE INVENTION

1. Field of the Invention

The present invention relates to a toner used for developing electrostatic latent images in electrophotography, electrostatic printing, etc., and more specifically concerns a non-magnetic toner used for developing electrostatic latent images in the non-magnetic developing system.

2. Description of the Related Art

Recently, there have been increasing demands for full-color image-forming apparatuses as image-forming apparatuses such as copying machines, printers, etc. In the full-color image-forming apparatus, a system has been well-known in which toner images of respective colors, formed on a photosensitive member, are successively transferred on an intermediate transfer member and temporarily held thereon, and then again transferred on a sheet of copy paper at one time.

Moreover, in recent years, various attempts have been made so as to achieve high-quality images in the field of electrophotography, and it has been recognized that down-sizing of toner particle size and toner conglobation are very effective for this purpose. However, as the toner particle size is made small, the transferring properties tend to decrease, resulting in poor image quality. On the other hand, it has been known that toner conglobation makes it possible to improve the toner transferring properties (see Japanese Patent Application Laid-Open No. 9-258474).

Under these circumstances, there are also demands for high-speed image-formation in the field of color copying machines and color printers.

Therefore, attempts have been made so as to achieve high speeds while providing high-quality images by using spherical toner. When an attempt is made to provide high speeds in an apparatus using the above-mentioned system, it is necessary to shorten the time required for copy paper to pass through the transferring section; therefore, it is necessary to increase the transferring pressure when an attempt is made to obtain the same transferring capability as conventionally obtained. However, when the transferring pressure is increased, toner tends to aggregate due to the pressure upon transferring, failing to carry out a preferable transferring process and causing an image loss during an image-formation.

SUMMARY OF THE INVENTION

The present invention is to provide a non-magnetic toner used for developing electrostatic latent images which has a superior transferring properties so that desired images can be obtained not only in a low-speed area, but also in a high-speed area.

The present invention relates to a non-magnetic toner for developing electrostatic latent images, having;

an average degree of roundness of not less than 0.960, a standard deviation of degree of roundness of not more than 0.040, a value of $D/d_{50}$ of not less than 0.40, in which $D=6/(\rho \cdot S)$ ($\rho$ is a true density of toner ($g/cm^3$), and S is a BET specific surface area of toner ($m^2/g$)); $d_{50}$ is an average weight particle size of toner, and an adhesive stress of 6 $g/cm^2$ or less under a compression of 1 $kg/cm^2$.

DETAILED DESCRIPTION OF THE INVENTION

Figure 1:
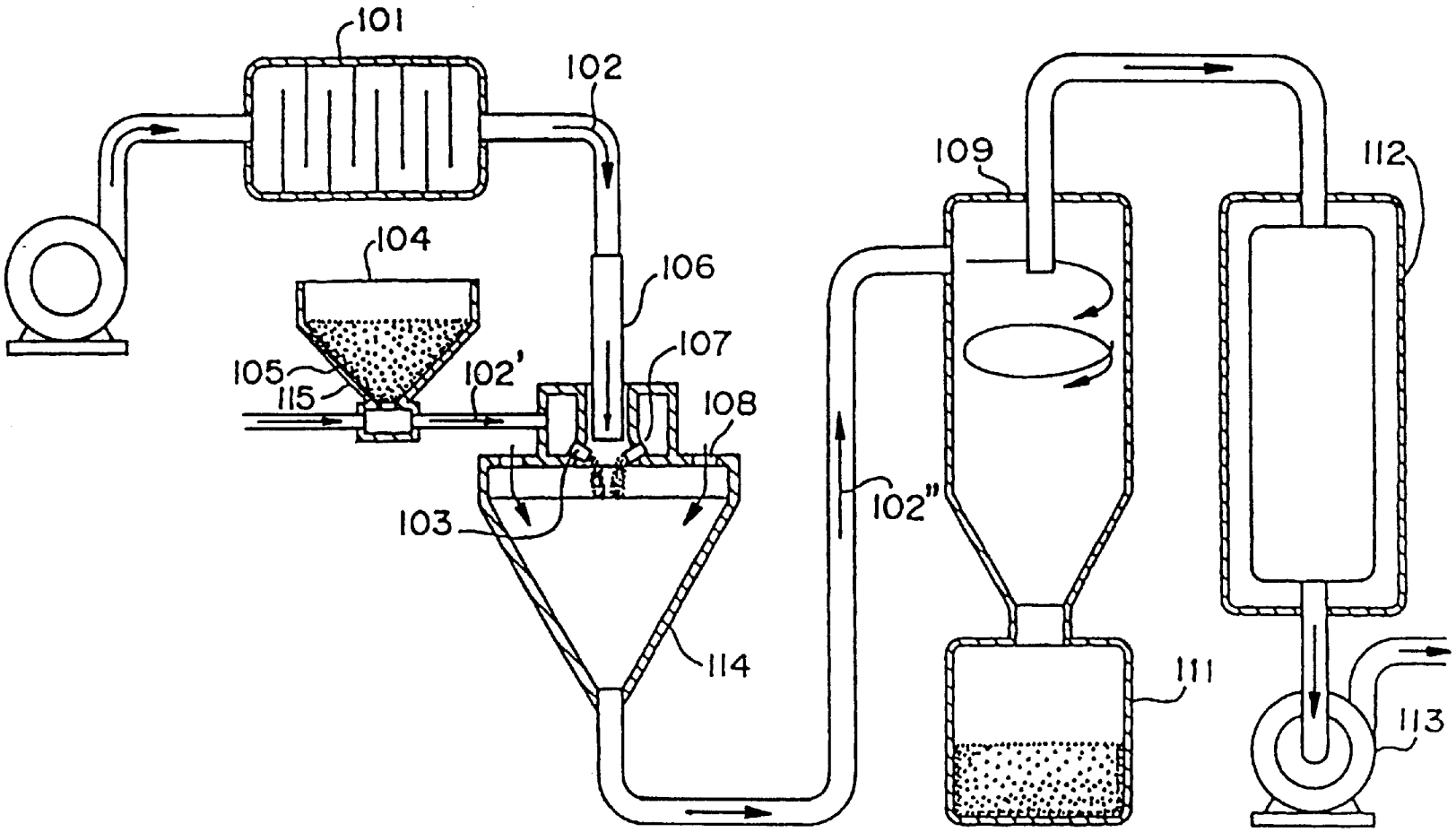
FIG. 1 is a schematic view of a device used for an instantaneous heating-treatment.

The present invention is characterized by a non-magnetic toner for developing electrostatic latent images, having;

an average degree of roundness of not less than 0.960, a standard deviation of degree of roundness of not more than 0.040, a value of $D/d_{50}$ of not less than 0.40, in which $D=6/(\rho \cdot S)$ ($\rho$ is a true density of toner ($g/cm^3$), and S is a BET specific surface area of toner ($m^2/g$)); $d_{50}$ is an average weight particle size of toner, and an adhesive stress of 6 $g/cm^2$ or less under a compression of 1 $kg/cm^2$.

In the toner of the present invention, each toner particle is conglobated, and a desired toner fluidity is ensured by reducing the irregularity of its shape, and the regulation of $D/d_{50}$ makes it possible to enhance the surface smoothness and reduce particle cracking so that the particle strength is improved. Further, it is possible to prevent aggregation of toner particles by reducing the adhesive stress. Thus, it becomes possible to ensure desired toner fluidity and shifting properties to the transferred member, and consequently to improve the transferring properties remarkably. As a result, it is possible to provide good image free from image noise such as image losses, etc., and also to easily meet demands for high-speed image-formation. Moreover, since the toner of the present invention has a uniform spherical shape, the electrification-build-up properties are improved, and a sharp distribution of quantity of charge is achieved; therefore, it is possible to reduce noise such as fog due to insufficient charge, and consequently to improve the image quality. Moreover, it is possible to eliminate a phenomenon such as selective developing (a phenomenon in which toner having a specific particle size or quantity of charge is first consumed selectively), and consequently to ensure toner quality stably even during an endurance printing process. Furthermore, the use of the toner of the present invention makes it possible to improve efficiency in developing and transferring processes, thereby providing a wide range of machine setting-conditions.

The toner of the present invention has an average degree of roundness of not less than 0.960, preferably not less than 0.965, and a standard deviation of the degree of roundness of not more than 0.040, preferably not more than 0.035. The average degree of roundness less than 0.960, or the standard deviation of the degree of roundness exceeding 0.040 causes degradation in the transferring properties due to a reduction in the fluidity, resulting in image losses. It becomes impossible to achieve high-speed image-formation and to maintain a desired adhesive stress.

In the present description, the average degree of roundness is an average value of values calculated by the following formula:

$$\text{Average degree of roundness} = \frac{\text{Peripheral length of a circle equal to projection area of a particle}}{\text{Peripheral length of a particle projection image}}$$

in which "Peripheral length of a circle equal to projection area of a particle" and "Peripheral length of a particle projection image" are values obtained through measurements carried out by a flow-type particle image analyzer (FPIA-1,000 or FPIA-2,000; made by Toa Iyoudenshi K.K.) in an aqueous dispersion system. The closer the value to 1, the closer the shape to true circle. Since the average degree of roundness is given from "Peripheral length of a circle equal to projection area of a particle" and "Peripheral length of a particle projection image", the resulting value provides an index that correctly reflects the irregular conditions of the surfaces of particles. Moreover, since the average degree of roundness is a value obtained as an average value with respect to 3,000 particles, the reliability of the degree of roundness of the present invention is very high. Additionally, in the present description, the average degree of roundness is not necessarily measured by the above-mentioned apparatus, and any apparatus may be used, as long as it is capable of carrying out the measurements based upon the above-mentioned equation in principle.

The standard deviation of the degree of roundness indicates the standard deviation in the distribution of the degree of roundness, and this value is obtained together with the average degree of roundness at the same time by the above-mentioned flow-type particle image analyzer. The smaller the value, the more uniform the toner particle shapes are.

With respect to the toner of the present invention, its surface characteristics satisfies the following conditional expression [I]:

$$D/d_{50} \geqq 0.40 \text{ in which } D=6/(\rho \cdot S) \qquad [I]$$

(in the formula [I], D represents a converted particle size ($\mu$m) from the BET specific surface area obtained when it is supposed that the toner shape is spherical); $d_{50}$ is a particle size ($\mu$m) corresponding to 50% of the relative weight distribution classified by particle sizes (weight-average particle size); $\rho$ is a true density of toner (g/cm$^3$); and S is a BET specific surface area of toner (m$^2$/g)). $D/d_{50}$ is preferably set at 0.40 to 0.80, more preferably 0.45 to 0.70. This $D/d_{50}$ is an index indicating the condition of surface of the toner particle. If the toner satisfies the above-mentioned value, it is possible to avoid problems such as: toner cracking at pore portions, embedding of silica etc. that are fluidizing agents added as externally added agents, and generation of fine particles caused by grinding of protruding portions. On the other hand, the value less than 0.40 causes degradation in the transferring properties due to a reduction in the fluidity resulting from toner cracking and embodiment of externally added agents. From the viewpoint that appropriate convex portions are formed with a fluidizing agent to improve toner chargeability, it is preferable that $D/d_{50}$ is 0.80 or less.

With respect to the BET specific surface area, values measured by Flow Sorb 2,300 (made by Simazu Seisakusho K.K.) are used. The measuring device is, however, not limited by this. Any device may be used as long as the measurements are carried out in the same measuring principle and method.

With respect to the particle size corresponding to 50% of the relative weight distribution classified by particle sizes ($d_{50}$) (weight-average particle size), values measured by a Coulter Multisizer (made by Coulter Counter K.K.) are used. The measuring device is, however, not limited by this. Any device may be used as long as the measurements are carried out in the same measuring principle and method.

The true density $\rho$ is a true density of toner, and represented by values measured by an air-comparative specific gravity meter (made by Beckman K.K.) are used. The measuring device is, however, not limited by this. Any device may be used as long as the measurements are carried out in the same measuring principle and method.

The toner of the present invention is set to have an adhesive stress of not more than 6 g/cm$^2$, preferably not more than 5.5 g/cm$^2$, under a compression of 1 kg/cm$^2$. The adhesive stress exceeding 6 g/cm$^2$ under a compression of 1 kg/cm$^2$ causes aggregation among toner particles in the transferring section, resulting in image losses in the copied image. This also causes adhering of toner to the toner-regulating blade at the time of developing by the use of mono-component developing system. A toner thin layer is not formed on the developing sleeve, resulting in degradation in the copied-image quality. The adhesive stress exceeding 2 g/cm$^2$ is preferable because transferring disorder caused by toner-scattering is prevented at the time when each color toner is transferred and superposed to form full-color images.

The toner adhesive stress is measured as follows: a compression-tensile characteristic-measuring device for a powder layer (Aggrobot: made by Hosokawa Micron K.K.) is used. Its cylindrical cell, which is separable into two upper and lower portions, is filled with particles of a predetermined amount. After the particles have been held under a pressure of 1 kg/cm$^2$, the upper cell is raised until the particle layer is broken. The toner adhesive stress is represented by a maximum tensile strength (g/cm$^2$) at the time when the particle layer is broken.

Measuring conditions:
Amount of sample: 6 g
Ambient temperature: 23° C.
Humidity: 50%
Cell inner diameter: 25 mm
Cell temperature: 25° C.
Spring line diameter: 1.0 mm
Compression rate: 0.1 mm/sec
Compression stress: 1 kg/cm$^2$
Compression holding time: 60 sec.
Tensile rate: 0.4 mm/sec.

The device for measuring the adhesive stress is not limited by the above-mentioned machine, and any device may be used as long as the measurements are carried out based on the same principle.

The adhesive stress may be adjusted by an average degree of roundness of toner, a standard deviation of degree of roundness of toner, a kind of fluidizing agent and an amount thereof. In order to decrease the adhesive stress, the following techniques are effective: the average degree of roundness is heightened, the standard deviation of degree of roundness is reduced, a fluidizing agent having a small specific surface area is used, an amount of addition of the fluidizing agent is increased. In the present invention, the above techniques are combined to adjust the adhesive stress.

The toner of the present invention is constituted of at least a binder resin and a colorant.

With respect to the binder resin, any thermoplastic resin, used for toner-constituting binder resins, may be adopted. In the present invention, those resins having a glass transition point of 50 to 75° C., a softening point of 80 to 160° C., a number-average molecular weight of 1,000 to 30,000 and a ratio of weight-average molecular weight/number-average molecular weight of 2 to 100, are preferably used.

In particular, in the case of preparation for full-color toner (including black toner), it is preferable to use resins having a glass transition point of 50 to 75° C., a softening point of 80 to 120° C., a number-average molecular weight of 2,000 to 30,000 and a ratio of weight-average molecular weight/number-average molecular weight of 2 to 20.

More preferable toner binder resin is a polyester resin with an acid value of 2 to 50 KOHmg/g, preferably 3 to 30 KOHmg/g in addition to the above-mentioned characteristics. By using the polyester resin having such an acid value, it is possible to improve the dispersing properties of various pigments including carbon black and charge-control agents, and also to provide a toner having a sufficient quantity of electrical charge. The acid value less than 2 KOHmg/g reduces the above-mentioned effects. The acid value exceeding 50 KOHmg/g fails to stably maintain the quantity of charge of toner against environmental fluctuations, in particular, fluctuations in humidity.

With respect to the polyester resin, polyester resins, obtained by polycondensating a polyhydric alcohol component with a polycarboxylic acid component, may be used.

Among polyhydric alcohol components, examples of dihydric alcohol components include: bisphenol A alkylene oxide additives, such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane and polyoxyethylene(2,0)-2,2-bis(4-hydroxyphenyl)propane, ethyleneglycol, diethyleneglycol, triethyleneglycol, 1,2-propyleneglycol, 1,3-propyleneglycol, 1,4-butanediol, neopentylglycol, 1,4-butenediol, 1,5-pentanediol, 1,6-hexanediol, 1,4-cyclohexanedimethanol, dipropyleneglycol, polyethyleneglycol, polytetramethyleneglycol, bisphenol A, hydrogenized bisphenol A, etc.

Examples of trihydric or more alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Moreover, among polycarboxylic acid components, examples of dicarboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenyl succinic acid, isododecenyl succinic acid, n-dodecyl succinic acid, n-dodecyl succinic acid, isododecyl succinic acid, n-octenylsuccinic acid, isooctenyl succinic acid, n-octyl succinic acid, isooctylsuccinic acid, and anhydrides or lower alkyl esters of these acids.

Examples of tri or more carboxylic acid components include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butane tricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, empol trimer acid, anhydrides and lower alkyl esters of these acids.

In the present invention, with respect to the polyester resin, a material monomer for a polyester resin, a material monomer for a vinyl resin and a monomer that reacts with both of the resin material monomers are used, and a polycondensating reaction for obtaining a polyester resin and a radical polymerization reaction for obtaining a styrene resin are carried out in parallel in the same container; and resins thus obtained may be preferably used. The monomer that reacts with both of the resin material monomers is, in other words, a monomer that can be used in both a polycondensating reaction and a radical polymerization reaction. That is, the monomer has a carboxyl group that undergoes a polycondensating reaction and a vinyl group that undergoes a radical polymerization reaction. Examples thereof include fumaric acid, maleic acid, acrylic acid, methacrylic acid, etc.

Examples of the material monomers for polyester resins include the above-mentioned polyhydric alcohol components and polycarboxylic acid components.

Examples of the material monomers for vinyl resins include: styrene or styrene derivatives, such as o-methylstyrene, m-methylstyrene, p-methylstyrene, α-methylstyrene, p-ethylstyrene, 2,4-dimethylstyrene, p-tert-butylstyrene and p-chlorostyrene; ethylene unsaturated monoolefins, such as ethylene, propylene, butylene and isobutylene; methacrylic acid alkyl esters, such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate and dodecyl methacrylate; acrylic acid alkyl esters, such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl) butyl acrylate, hexyl acrylate, octyl acrylate, nonyl acrylate, decyl acrylate, undecyl acrylate, and dodecyl acrylate; unsaturated carboxylic acids, such as acrylic acid, methacrylic acid, itaconic acid and maleic acid; acrylonitrile, maleic acid ester, itaconic acid ester, vinyl chloride, vinylacetate, vinylbenzoate, vinylmethylethylketone, vinyl hexyl ketone, vinyl methyl ether, vinyl ethyl ether, and vinyl isobutyl ether. Examples of polymerization initiators used when the material monomers for vinyl resins are polymerized include azo or diazo polymerization initiators such as 2,2'-azobis(2,4-dimethylvaleronitrile, 2,2'-azobisisobutyronitrile, 1,1'-azobis(cyclohexane-1-carbonitrile) and 2,2'-azobis-4-methoxy-2,4-dimethylvaleronitrile and peroxide polymerization initiators such as benzoyl peroxide, methyl ethyl ketone peroxide, isopropylperoxycarbonate and lauroyl peroxide.

In the full-color process requiring light-transmitting properties, resins of a sharply-melting type, which have a sharp molecular weight distribution, are conventionally used. The use of such type of resins makes it possible to reproduce glossy and pictorial images. However, in recent years, in color copying normally used in offices, there are increasing demands for images with less degree of gloss. In order to meet such demands, for example, the molecular weight distribution of the resin is widened to the high-molecule side. One of the specific methods for this is to use two or more kinds having different molecular weights in a combined manner. When the resin thus obtained finally through the combination has a glass transition point of 50 to 75° C., a softening point of 80 to 120° C., a number-average molecular weight of 2,500 to 30,000 and a ratio of weight-average molecular weight/number-average molecular weight in the range of 2 to 20, it is preferably adopted. When copied images are desired to have less gloss, the value of the ratio of weight-average molecular weight/number-average molecular weight is set at not less than 4 so that the melt-viscosity curve is tilted. Thus, it becomes possible to expand the gloss-degree controlling-range with respect to the fixing temperature.

Epoxy resins may be preferably used, in particular, in full-color toners. Examples of epoxy resins preferably used in the present invention include polycondensated products of bisphenol A with epichlorohydrin. For example, Epomic R362, R364, R365, R367, R369 (made by Mitsui Sekiyukagaku K.K.), Epotot YD-011, YD-012, YD-014, YD-904, YD-017 (made by Touto Kasei K.K.) and Epi Coat 1002, 1004, 1007 (made by Shell Kagaku K.K.) are commercially available.

In the present invention, the softening point of resins are measured by a flow tester (CFT-500: made by Shimadzu Seisakusho K.K.) in which: 1 $cm^3$ of a sample was melted and flowed under the conditions of a thin pore of die (diameter 1 mm, length 1 mm), an applied pressure of 20 $kg/cm^2$ and a temperature-rising rate of 6° C./min, and the temperature corresponding to ½ of the height from a flowing start point to a flowing terminal point was defined as the softening point. The glass transition point is measured by a differential scanning calorimeter (DSC-200: made by Seiko Denshi K.K.) in which: based upon alumina as the reference, 10 mg of a sample was measured under the conditions of a temperature-rising rate of 10° C./min and at temperatures ranging from 20 to 120° C., and the shoulder value of the main heat-absorption peak was defined as the glass transition point. With respect to the acid value, 10 mg of a sample was dissolved in 50 ml of toluene, and this was titrated by a solution of N/10 potassium hydroxide/alcohol that had been preliminarily standardized, in the presence of a mixture indicator of 0.1% of bromo-thymol blue and phenol red. The value was calculated from an amount of consumption of the solution of N/10 potassium hydroxide/alcohol. The molecular weight (number-average molecular weight, weight-average molecular weight) were obtained by the gel-permeation chromatography (GPC) method and converted based upon styrene.

In order to improve the anti-offset properties, etc., the toner of the present invention may contain a wax. Examples of such a wax include polyethylene wax, polypropylene wax, carnauba wax, rice wax, sazol wax, montan ester waxes, Fischer-Tropsch wax, etc. In the case of addition of a wax to the toner, the content is preferably in the range of 0.5 to 5 parts by weight relative to 100 parts by weight of the binder resin. Thereby, it becomes possible to obtain the effects of the addition without causing disadvantages, such as filming, etc.

From the viewpoint of improvement in anti-offset properties, polypropylene wax is preferably contained. From the viewpoint of improvements in smear-preventive properties ("smear" means a phenomenon in which, when a paper-sheet with images copied on its one side is fed by an automatic document-feeding apparatus or in a double-sided copying machine, degradation in the copied image, such as blurring and stains, occurs due to friction between the sheets or between the sheet and rollers on the image), polyethylene wax is preferably contained. From the above-mentioned view points, the polypropylene wax is preferably set to have a melt viscosity of 50 to 300 cps at 160° C., a softening point of 130 to 160° C. and an acid value of 1 to 20 KOH mg/g. The polyethylene wax is more preferably set to have a melt viscosity of 1,000 to 8,000 cps at 160° C. and a softening point of 130 to 150° C. The polypropylene wax having the above-mentioned melt viscosity, softening point and acid value exhibits a superior dispersing properties to the binder resin. The anti-offset properties are improved without causing problems due to isolated wax. In particular, when polyester resin is used as the binder resin, oxidized-type waxes are preferably used.

Examples of waxes of oxidized type include oxidized polyolefin waxes, carnauba wax, montan wax, rice wax, and Fischer-Tropsch wax, etc.

With respect to polypropylene waxes which are polyolefin waxes, low molecular weight polypropylene has a small hardness to cause the defect of lowering the toner fluidity. It is preferable that those waxes are modified with carboxylic acid or acid anhydride in order to improve the above defects. In particular, modified polypropylene resins in which a low molecular polypropylene resin is modified with one or more kinds of acid monomers selected from the group consisting of (metha)acrylate, maleic acid and maleic acid anhydride, are preferably used. Such a modified polypropylene may be obtained, for example, by subjecting a polypropylene resin to a graft or addition reaction with one or more kinds of acid monomers selected from the group consisting of (metha) acrylate, maleic acid and maleic acid anhydride in the presence of a peroxide catalyst or without a catalyst. When the modified polypropylene is used, the acid value is set in the range of 0.5 to 30 KOHmg/g, preferably 1 to 20 KOHmg/g.

With respect to the oxidized-type polypropylene waxes, Viscol 200TS (softening point 140° C., acid value 3.5), Viscol 100TS (softening point 140° C., acid value 3.5), Viscol 110TS (softening point 140° C., acid value 3.5), each of which is made by Sanyo Kasei Kogyo K.K., etc., are commercially available.

With respect to oxidized-type polyethylene, commercially available products are: San Wax E300 (softening point 103.5° C., acid value 22) and San Wax E250P (softening point 103.5° C., acid value 19.5), made by Sanyo Kasei Kogyo K.K.; Hi-Wax 4053E (softening point 145° C., acid value 25), 405MP (softening point 128° C., acid value 1.0), 310MP (softening point 122° C., acid value 1.0), 320MP (softening point 114° C., acid value 1.0), 210MP (softening point 118° C., acid value 1.0), 220MP (softening point 113° C., acid value 1.0), 4051E (softening point 120° C., acid value 12), 4052E (softening point 115° C., acid value 20), 4202E (softening point 107° C., acid value 17) and 2203A (softening point 111° C., acid value 30), made by Mitsui Sekiyukagaku K.K., etc.

When carnauba wax is used, the ones of fine crystal particles are preferably used with their acid value preferably in the range of 0.5 to 10 KOHmg/g, preferably 1 to 6 KOHmg/g.

Montan waxes generally refer to montan ester waxes refined from minerals, being in the form of fine crystals as well as carnauba wax; the acid value thereof is preferably in the range of 1 to 20 KOHmg/g, and more preferably, 3 to 15 KOHmg/g.

Rice wax is obtained by air-oxidizing rice bran wax, and its acid value being preferably in the range of 5 to 30 KOHmg/g.

Fischer-Tropsch wax is a wax that is produced as a by-product when synthetic oil is produced from coal according to the hydrocarbon-synthesizing method. Such a wax, for example, is available as trade name "sazol wax" made by Sazol K.K. Fischer-Tropsch wax, made from natural gas as a starting material, may be preferably used since it contains less low molecular weight ingredients and exhibits a superior heat resistance when used with toner.

With respect to the acid value of Fischer-Tropsch wax, those having an acid value of 0.5 to 30 KOHmg/g may be used. Among sazol waxes, those of oxidized type having an acid value of 3 to 30 KOHmg/g (trade name: sazol wax A1, A2, etc.) are, in particular, preferably used. Polyethylene wax having the above-mentioned melt viscosity and softening point also exhibits a superior dispersing properties to the binder resin, thereby improving the smear-preventive properties because frictional coefficient of the surface of a fixed image is reduced without causing problems due to isolated wax. The melt viscosity of wax was measured by a viscometer of the Brook Field type.

Known pigments and dyes are used as colorants for full-color toner. Examples of them include carbon black, aniline blue, chalcoil blue, chrome yellow, ultramarine blue, DuPont Oil Red, quinoline yellow, methylene blue chloride, copper phthalocyanine, Malachite green oxalate, Lump Black, Rose Bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Solvent Yellow 162, C.I. Pigment Yellow 180, C.I. Pigment Yellow 185, C.I. Pigment Blue 15:1, C.I. Pigment Blue 15:3, etc. An amount of addition of these colorants is preferably set in the range of 2 to 10 parts by weight with respect to 100 parts by weight of the binder resin.

In the toner of the present invention, additive agents such as a charge-control agent and said waxes may be added to its binder resin depending on various purposes. For example, for the charge-control agent, the following compounds may be added: a fluorine surface-active agent, a metal-containing dye such as a metal complex of salicylic acid and an azo-series metal compound, a high molecular acid such as a copolymer containing maleic acid as a monomer component, a quaternary ammonium salt, an azine dye such as nigrosine, carbon black, etc.

In the toner of the present invention, it is preferable to admix various organic/inorganic fine particles as post-treating agents after preparation of toner-particles. Examples of the inorganic fine particles include various kinds of carbides, such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond carbon lactam; various nitrides such as boron nitride, titanium nitride and zirconium nitride; bromides such as zirconium bromide; various oxides, such as titanium oxide, calcium oxide, magnesium oxide, zinc oxide, copper oxide, aluminum oxide, silica and colloidal silica; various titanic acid compounds, such as calcium titanate, magnesium titanate and strontium titanate; sulfides such as molybdenum disulfide; fluorides such as magnesium fluoride and carbon fluoride; various metal soaps, such as aluminum stearate, calcium stearate, zinc stearate and magnesium stearate; and various nonmagnetic inorganic fine particles such as talc and bentonite. These materials may be used alone or in combination. In particular, it is preferable that the inorganic fine particles such as silica, titanium oxide, alumina and zinc oxide are treated by a known method with a conventionally used hydrophobisizing agent, such as a silane coupling agent, a titanate coupling agent, silicone oil and silicone vanish, or with a treatment agent, such as a fluorine silane coupling agent or fluorine silicone oil, a coupling agent having an amino group or a quaternary aluminum salt group, and a modified silicone oil.

With respect to the organic fine particles, various organic fine particles, such as styrene particles, (metha)acrylic particles, benzoguanamine, melamine, Teflon, silicon, polyethylene and polypropylene, which are formed into particles by a wet polymerization method such as an emulsion polymerization method, a soap-free emulsion polymerization method and a non-aqueous dispersion polymerization method, and a vapor phase method, etc, may be used. These organic fine particles also works as a cleaning-assist agent.

Inorganic fine particles, such as titanate metal salts, having a comparatively large particle size, and various organic fine particles may be, or may not be subjected to a hydrophobic treatment. An amount of addition of these post-treating agent is preferably from 0.1 to 5 parts by weight, preferably from 0.5 to 3 parts by weight, with respect to 100 parts by weight of the toner particles. However, in the case where inorganic fine particles are already added at the time of producing the toner particles, for example, in the case where inorganic fine particles are added prior to a heat treatment as will be described later, it is preferable to properly adjust the amount of addition before and after the heat treatment.

As the post-treatment agent added externally to the toner particles, it is preferable to use inorganic fine particles having a BET specific surface area of 1 to 350 $m^2/g$.

From the viewpoint of improvement of fluidity of toner, the inorganic fine particles for post-treatment have a BET specific surface area of 100 to 350 $m^2/g$, preferably 130 to 300 $m^2/g$. It is preferable that the inorganic fine particles are subjected to a hydrophobic treatment with a hydrophobic agent.

From the viewpoint of improvement of environmental stability and endurance stability of toner, the inorganic fine particles have a BET specific surface area of 1 to 100 $m^2/g$, preferably 5 to 90 $m^2/g$, more preferably 5 to 80 $m^2/g$.

When both the inorganic fine particles for fluidity-improvement and the inorganic fine particles for stability-improvement are used in combination, it is preferable that a difference of the BET specific surface area between the two is 30 $m^2/g$ or more, preferably 50 $m^2/g$ or more.

The toner of the present invention may be produced by any method as long as the above-mentioned properties can be controlled. In the toner of the present invention, the above-mentioned binder resin, colorants and other desired additive agents are mixed, kneaded, pulverized and classified by a conventional method so as to obtain toner base-particles having a desired particle size, and the particles thus obtained are preferably subjected to an instantaneous heating-treatment. The following description will discuss the case in which the kneading-pulverizing method is adopted as a method for preparing the toner base-particles. However, the present invention is not intended to be limited by this method, and the toner base-particles maybe obtained by a known wet method, such as an emulsion dispersing granulation method, an emulsion polymerization method and a suspension polymerization method, and the particles thus obtained may be subjected to an instantaneous heating-treatment.

A weight-average particle size of the toner base-particle before the instantaneous heating-treatment is set in the range of 4 to 10 $\mu$m, preferably 5 to 9 $\mu$m. A ratio of content of those particles having a particle size of not less than two times ($2d_{50}$) the weight-average particle size is set to not more than 0.5% by weight, preferably not more than 0.3% by weight. A ratio of content of those particles having a particle size of not more than ⅓ ($d_{50}/3$) of the weight-average particle size is set to not more than 5 number %, preferably not more than 4 number %. The particles, obtained at this stage, have virtually the same particle size distribution even after the instantaneous heating-treatment.

The classifying process may be carried out after the instantaneous heating-treatment of the present invention. It is preferable to use a granulator which allows the pulverized particles to have a spherical shape as a pulverizer used in the pulverizing process. The instantaneous heating-treatment, which is to be carried out successively, can be controlled more easily. Examples of such a device include an Inomizer System (made by Hosokawa Micron K.K.), a Criptron System (made by Kawasaki Jyukogyo K.K.), etc. As a classifier used in the classifying process, it is preferable to use such a classifier as to allow the processed particles to have a spherical shape. This makes it easier to control the degree of roundness, etc. Examples of such a classifier include a Teeplex Classifier (made by Hosokawa Micron K.K.).

The instantaneous heating-treatment preferably adopted in the present invention may be carried out in combination with various processes in surface-modifying devices for various developers. Examples of these surface-modifying devices include surface-modifying devices using the high-speed gas-flow impact method, such as Hybridization System (made by Narakikai Seisakusho K.K.), a Criptron Cosmos System (made by Kawasaki Jyukogyo K.K.) and an Inomizer System (made by Hosokawa Micron K.K.), surface-modifying devices using the dry mechanochemical method, such as a Mechanofusion System (made by Hosokawa Micron K.K.) and a Mechanomill (made by Okadaseikou K.K.), and surface-modifying devices in which the wet coating method is applied, such as a Dispacoat (made by Nisshin Engineering K.K.) and Coatmizer (made by Freund Sangyo K.K.). And these devices maybe used appropriately in a combined manner.

In the present invention, the instantaneous heating-treatment controls the toner base particles obtained through the keading-pulverizing method so as to provide a uniform spherical shape, increases the smoothing properties, and reduces the adhesive stress. This makes it possible to provide a toner which is superior in transferring properties, uniformity in electrical charging, and in image-forming performance, eliminates phenomena such as selective developing in which toner having specific particle size, shape and ingredient in the developer and a specific quantity of charge is first consumed selectively, and achieves a stable image-forming performance for a long time. Even when applied as a small-particle-size toner which contains as its main component a low-softening-point binder resin that is suitable for a high image-quality, low consumption (coloring material is highly-filled) and a low-energy fixing system, those properties being highly demanded in recent years, and which contains a coloring material at high filing-rate, the toner of the present invention exhibits an appropriate adhesive properties to the toner-supporting members (carrier, developing sleeves, developer rollers, etc.), the photosensitive member and the transferring members, and also has a superior moving properties. Fluidity is excellent, uniformity in electrical charge is improved, and a stable durability is ensured for a long time.

With respect to the instantaneous heating-treatment of the present invention, it is preferable to surface-modify the toner by heat by dispersing and spraying the toner particles in a hot air flow of compressed air. Thus, it becomes possible to easily control the above-mentioned properties that are defined by the present invention.

Figure 2:
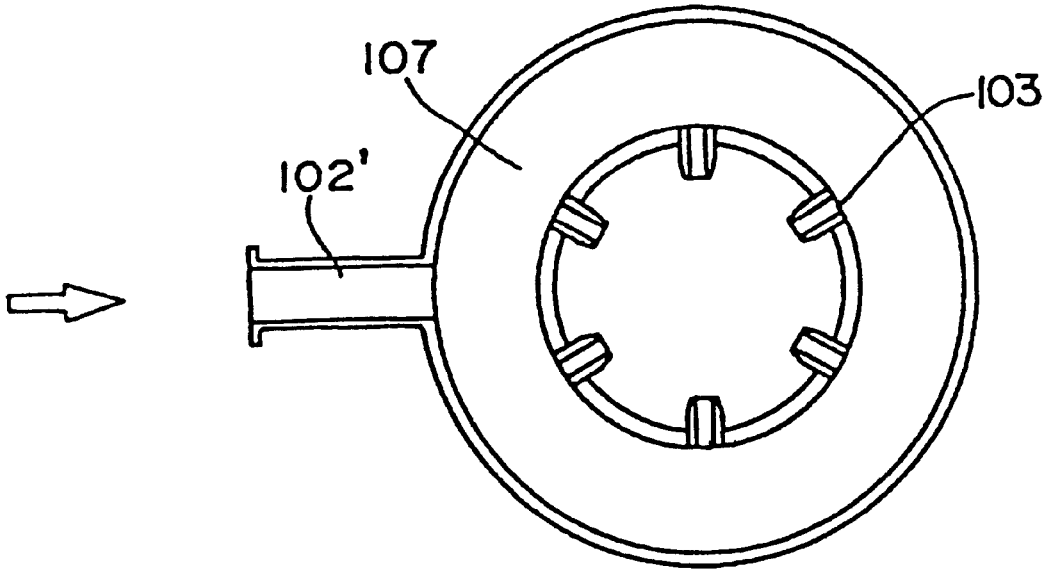
FIG. 2 is a schematic horizontal cross-sectional view showing a sample-ejecting chamber in the device of FIG. 1.

Referring to schematic views of FIGS. 1 and 2, the following description will discuss the construction of a preferable device that carries out the instantaneous heating-treatment. As illustrated in FIG. 1, high-temperature, high-pressure air (hot air), formed in a hot-air generating device 101, is ejected by a hot-air jetting nozzle 106 through an induction pipe 102. Toner particles 105 are transported by a predetermined amount of pressurized air from a quantitative supplying device 104 through an induction pipe 102', and fed to a sample-ejecting chamber 107 installed around the hot-air ejecting nozzle 106.

As illustrated in FIG. 2, the sample-ejecting chamber 107 has a hollow doughnut shape, and a plurality of sample-ejecting nozzles 103 are placed on its inside wall with the same intervals. The toner particles, sent to the sample-ejecting chamber 107, are allowed to spread inside the ejecting chamber 107 in a uniformly dispersed state, and discharged through the sample-ejecting nozzles 103 into the hot air flow by the pressure of air successively sent thereto.

It is preferable to provide a predetermined tilt to the sample-ejecting nozzles 103 so as not to allow the discharging flow from each sample-ejecting nozzle 103 to cross the hot air flow. More specifically, the ejection is preferably made so that the toner-ejecting flow runs along the hot air flow to a certain extent. An angle formed by the toner ejecting flow and the direction of the central flow of the hot air flow is preferably set in the range of 20 to 40°, preferably 25 to 35°. The angle wider than 40° causes the toner ejecting flow to cross the hot air flow, resulting in collision with toner particles discharged from other nozzles and the subsequent aggregation of the toner particles. The angle narrower than 20° left some toner particles not being taken in the hot air flow, resulting in irregularity in the toner particle shape.

A plurality of the sample-ejecting nozzles 103, preferably at least not less than 3, more preferably not less than 4 are required. The use of a plurality of the sample-ejecting nozzles makes it possible to uniformly disperse the toner particles into the hot air flow, and to ensure a heating treatment for each of the toner particles. With respect to the ejected state from the sample-ejected nozzle, it is desirable that the toner particles are widely scattered at the time of ejection and dispersed to the entire hot air flow without collision with other toner particles.

The toner particles, thus ejected, are allowed to contact with the high-temperature hot air instantaneously, and subjected to a heating treatment uniformly. "Instantaneously" refers to a time period during which a required toner-particle improvement (heating treatment) has been achieved without causing aggregation between the toner particles; and although it depends on the processing temperature and the density of toner particles in the hot air flow, this time period is normally set at not more than 2 seconds, preferably not more than 1 second. This instantaneous time period is represented as a residence time of toner particles from the time when the toner particles are ejected from the sample-ejecting nozzles to the time when they are transported into the induction pipe 102". The residence time exceeding 2 seconds is likely to cause bonding of particles.

The toner particles, which have been instantaneously heated, are cooled off by a cold air flow introduced from a cooling-air induction section 108, and collected into a cyclone 109 through the induction pipe 102" without adhering to the device walls and causing aggregation between particles, and then stored in a production tank 111. The carrier air from which the toner particles have been removed is allowed to pass through a bug filter 112 by which fine powder is removed therefrom, and released into the air through a blower 113. The cyclone 109 is preferably provided with a cooling jacket through which cooling water runs, so as to prevent aggregation of toner particles.

In addition, important conditions for carrying out the instantaneous heating treatment include an amount of hot air, an amount of dispersing air, a dispersion density, a processing temperature, a cooling air temperature, an amount of suction air and a cooling water temperature.

The amount of hot air refers to an amount of hot air supplied by the hot-air generating device 101. The greater the amount of hot air, the better in an attempt to improve the homogeneity of the heating treatment and the processing performance.

The amount of dispersing air refers to an amount of air that is to be sent to the induction pipe 102' by the pressurized air. Although it also depends on other conditions, the amount of dispersing air is preferably suppressed during the heating treatment. Dispersing state of toner particles are improved and stabilized.

The dispersion density refers to a dispersion density of toner particles in a heating treatment area (more specifically, a nozzle-jetting area). A preferable dispersion density varies depending on the specific gravity of toner particles; and the value obtained by dividing the classified density by the specific gravity of toner particles is preferably set in the range of 50 to 300 g/m$^3$, preferably 50 to 200 g/m$^3$.

The processing temperature refers to a temperature within the heating treatment area. In the heating treatment area, a temperature gradient spreading outwards from the center actually exists, and it is preferable to reduce this temperature distribution at the time of the heating treatment. It is preferable from the viewpoint of device mechanism to supply an air flow in a stable layer-flow state by using a stabilizer, etc. In the case of a non-magnetic toner containing a binder resin having a sharp molecular-weight distribution, for example, a binder resin having a ratio of weight-average molecular weight/number-average molecular weight of 2 to 20, it is preferable to carry out the heating treatment in a peak-temperature range between the glass transition point of the binder resin+100° C. and the glass transition point thereof+300° C. It is more preferable to carry it out in a peak-temperature range between the glass transition point of the binder resin+120° C. and the glass transition point thereof+250° C. The peak temperature range refers to a maximum temperature in the area in which the toner contacts with the hot air.

When wax is added to the toner particles, particles are more likely to bond. For this reason, some adjustment of conditions maybe required. For example, it is preferable that an amount of a fluidizing agent (especially, fluidizing agent having a large particle size) prior to the heating treatment is set higher. The dispersion density is set lower at the time of the treatment, etc. These adjustments are significant to obtain uniform toner particles with shape-irregularity suppressed. These operations are particularly important when a binder resin having a relatively wide molecular weight distribution is used or when the processing temperature is set to a high level in order to heighten the degree of roundness.

The cooling air temperature refers to a temperature of cold air introduced from the cooling-air introduction section 108. The toner particles, after having been subjected to an instantaneous heating treatment, are preferably placed in an atmosphere of a temperature not more than the glass transition point by using cold air so as to be cooled to a temperature range which causes no aggregation or bonding of the toner particles. Therefore, the temperature of the cooling air is set at not more than 25° C., preferably not more than 15° C., more preferably not more than 10° C. However, an excessively lowered temperature might cause dew condensation in some conditions and adverse effects; this must be noted. In the instantaneous heating treatment, together with a cooling effect by cooling water in the device as will be described next, since the time in which the binder resin is in a fused state is kept very short, it is possible to eliminate aggregation between the particles and adhesion of the particles to the device walls of the heat treatment device. Consequently, it becomes possible to provide superior stability even during continuous production, to greatly reduce the frequency of cleaning for the manufacturing devices, and to stably maintain the yield high.

The amount of suction air refers to air used for carrying the processed toner particles to the cyclone by the blower 113. The greater the amount of suction air, the better in reducing the aggregation of the toner particles.

The temperature of cooling water refers to the temperature of cooling water inside the cooling jacket installed in the cyclones 109 and 114 and in the induction pipe 102". The temperature of cooling water is set at not more than 25° C., preferably not more than 15° C., more preferably not more than 10° C.

In order to more easily control the average degree of roundness, the standard deviation of the degree of roundness, the surface smoothness and the adhesive stress of the toner when carrying out the heating-treatment, it is preferable to further take the following measures.

(1) The amount of toner particles to be supplied to the hot air flow is kept constant without generating pulsating movements, etc. For this purpose;

(i) a plurality of devices, such as a table feeder 115 shown in FIG. 1 and a vibration feeder, are used in combination so as to improve the quantitative supplying properties. If a high-precision quantitative supply is achieved by using a table feeder and a vibration feeder, finely-pulverizing and classifying processes can be connected thereto so that toner particles can be supplied on-line to the heating treatment process;

(ii) After having been supplied by compressed air, prior to supplying toner particles into hot air, the toner particles are re-dispersed inside the sample-supplying chamber 107 so as to enhance the dispersion uniformity. For example, the following measures are adopted: the re-dispersion is carried out by using secondary air; the dispersed state of the toner particles is uniformed by installing a buffer section; and the re-dispersion is carried out by using a co-axial double tube nozzle, etc.

(2) When sprayed and supplied into a hot air flow, the dispersion density of the toner particles is optimized and controlled uniformly.

For this purpose;

(i) the supply into the hot air flow is carried out uniformly, in a highly dispersed state, from all circumferential directions. More specifically in the case of supply from dispersion nozzles, those nozzles having a stabilizer, etc. are adopted so as to improve the dispersion uniformity of the toner particles that are dispersed from each of the nozzles;

(ii) In order to uniform the dispersion density of the toner particles in the hot air flow, the number of nozzles is set to at least not less than 3, preferably not less than 4, as described earlier. The greater the number, the better, and these nozzles are arranged symmetrically with respect to all the circumferential directions. The toner particles may be supplied uniformly from slit sections installed all the 360-degree circumferential areas;

(3) Control is properly made so that no temperature distribution of the hot air is formed in the processing area of toner particles so as to apply uniform thermal energy to each of the particles, and the hot air is maintained in a layer-low state.

For this purpose;

(i) the temperature fluctuation of a heating source for supplying hot air is reduced.

(ii) A straight tube section preceding the hot-air supplying section is made as long as possible. Alternatively, it is preferable to install a stabilizer in the vicinity of the hot-air supplying opening so as to stabilize the hot air. Moreover, the device construction, shown in FIG. 1 as an example, is an open system; therefore, since the hot air tends to be dispersed in a direction in which it contacts outer air, the supplying opening of the hot air may be narrowed on demands.

(4) The toner particles are subjected to a sufficient fluidizing treatment so as to be maintained in a uniform dispersed state during the heating treatment. For this purpose;

(i) in order to maintain sufficient dispersing and fluidizing properties of the toner particles, various organic/inorganic fine particles having a particle size of not more than 1/20 of that of the toner particles, preferably not more than 1/50 thereof, are preferably used. In particular, inorganic fine particles (first inorganic fine particles) which are subjected to a hydrophobic treatment and have a BET specific surface area of 100 to 350 $m^2/g$) are preferably used. With respect to the materials of these first inorganic fine particles, the aforementioned inorganic fine particle materials may be used, and in particular, hydrophobic silica is preferably used. An amount of addition is preferably set in the range of 0.1 to 5 parts by weight, preferably 0.3 to 3 parts by weight, with respect to 100 parts by weight of the toner particles.

(ii) In a mixing process for improving the dispersing and fluidizing properties, each of the fine particles is preferably located on the surface of the toner particle uniformly in an adhering state without being firmly fixed thereon.

(5) Even when the surface of the toner particle is subjected to heat, particles which have not been softened are located on the surface of the toner particle so that a spacer effect is maintained between the toner particles.

For this purpose;

(i) it is preferable to add various organic/inorganic fine particles which have a relatively larger particle size as compared with the various organic/inorganic fine particles as described in (4), and are not susceptible to softening at processing temperatures. In particular, inorganic fine particles (second inorganic fine particles) which are subjected to a hydrophobic treatment and have a BET specific surface area of 50 to 100 $m^2/g$ are preferably used. With respect to the materials of these second inorganic fine particles, the aforementioned inorganic fine particle materials may be used, and in particular, hydrophobic silica, titanium oxide, alumina and zinc oxide are preferably used. The existence of the fine particles on the surface of the toner particle prevents the toner particle surface from forming a surface entirely made from the resin component even after heat is started to be applied, thereby providing the spacer effect between the toner particles and also preventing aggregation and bonding between the toner particles. Further, this also greatly contributes to a reduction in adhesive stress, thereby preventing the toner aggregation.

(ii) An amount of addition of the second inorganic fine particles is set to 0.3 to 5 parts by weight, preferably 0.5 to 3 parts by weight, with respect to 100 parts by weight of the toner particles, and with respect to the total amount of the first and second inorganic fine particles, it is preferably set to 0.4 to 10 parts by weight, preferably 0.8 to 6 parts by weight.

When the both the first and the second inorganic fine particles are used in combination, a difference of the BET specific surface area between the two is set to 30 $m^2/g$ or more.

Such inorganic fine particles as mixed with the toner particles are fixed on surface of the toner particles by the instantaneous heat treatment.

(6) The collection of the heat-treated product must be controlled so as not to generate heat.

For this purpose;

(i) the particles that are subjected to the heating-treatment and cooling process are preferably cooled in a chiller in order to reduce heat generated in the piping system (especially, in R portions) and in the cyclone normally used in the collection of the toner particles.

(7) In the case of a process using toner having a relatively greater specific gravity with a small amount of resin component that contributes to the heating-treatment, it is preferable to surround the heat-treating space in a cylinder shape so as to increase the time during which the treatment is virtually carried out, or to carry out a plurality of the treatments.

The full-color developing toner of the present invention, obtained as described above, is effectively used in a full-color image-forming method in which: a toner image formed on an image-supporting member is pressed and transferred onto an intermediate transfer member for each of colors in a superimposed manner, and the toner image transferred on the intermediate transfer member is pressed and transferred onto a recording member. In other words, in the full-color image-forming method using the above-mentioned toner of the present invention, it is possible to prevent image losses of toner images, scattering of toner and occurrences of image-fogging in full-color copied images, and also to provide superior transferring properties and following properties (moving properties). No toner selection (with respect to shape, size, etc.) occurs on the toner supporting member to provide stable images for a long time. Since the toner of the present invention has a superior toner shape and surface smoothness, it has high durability against stress so that it is possible to reduce the implantation of post-processing agents and the generation of fine particles due to cracking of toner. Even in the case of the application of resins having low softening points capable of providing a low-temperature fixing properties and a light-transmitting properties for OHP, which are the properties recently demanded, the toner of the present invention fully satisfies the required performance (quality). It also becomes possible to achieve a wider scope of operability with high system speeds and long life in image-forming apparatuses such as printers.

An explanation will be given of a full-color image-forming method using the above-mentioned full-color developing toner by exemplifying a known full-color image-forming apparatus shown in FIG. 3. In the full-color image-forming apparatus, a photosensitive member is used as the image-supporting member, an endless intermediate transfer belt is used as the intermediate transfer member, and a sheet of recording paper is used as the recording member.

Figure 3:
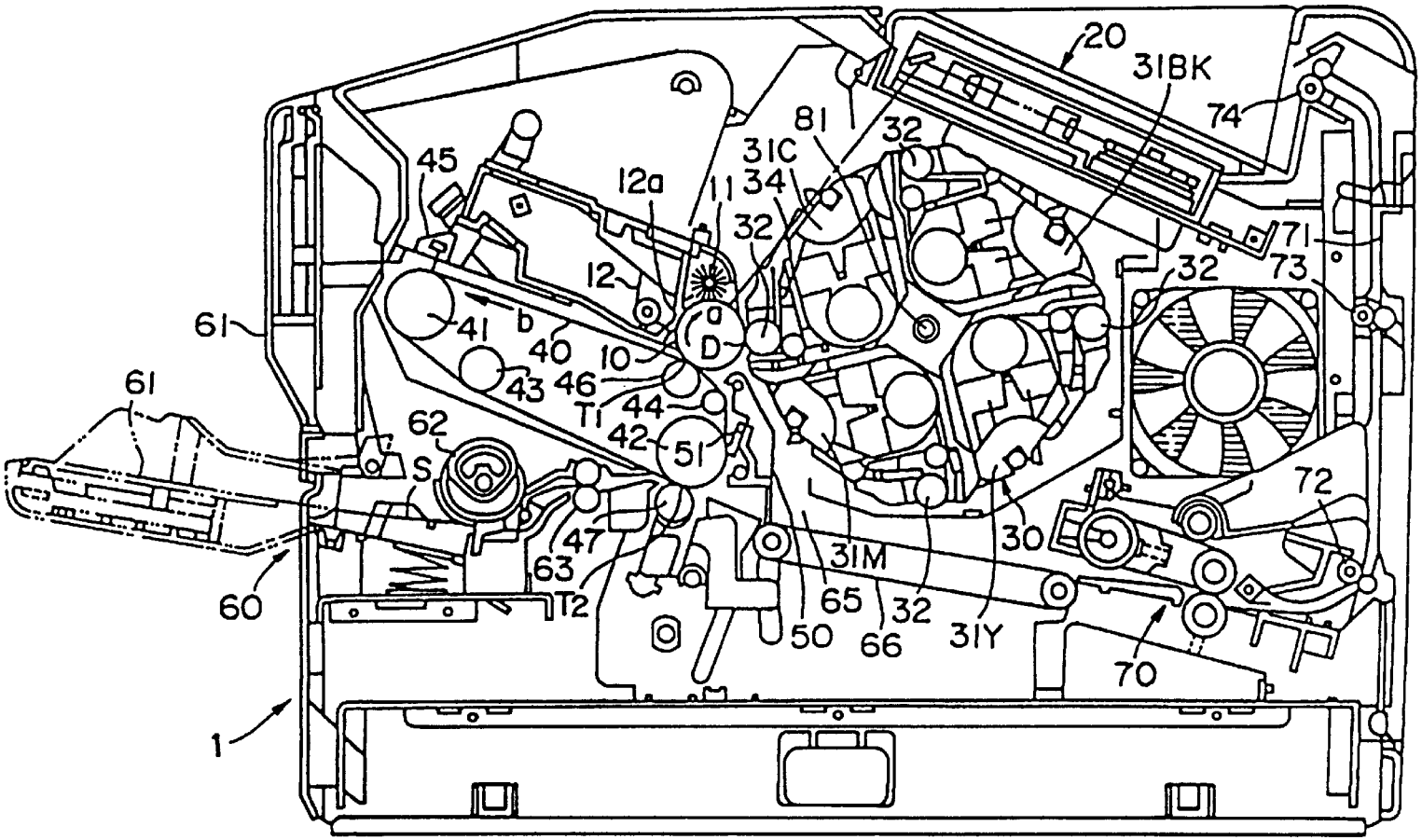
FIG. 3 is a schematic view of a mono-component full-color image-forming apparatus.

In FIG. 3, the full-color image-forming apparatus is schematically constituted by a photoconductive drum 10 that is rotationally driven in the arrow a direction, a laser scanning optical system 20, a full-color developing device 30, an endless intermediate transfer belt 40 that is rotationally driven in the arrow b direction, and a paper-feed section 60. On the periphery of the photoconductive drum 10 are further installed a charging blush 11 for charging the surface of the photoconductive drum 10 to a predetermined electric potential, and a cleaner 12 having a cleaner blade 12*a* for removing toner remaining on the photoconductive drum 10. In the present embodiment, the cleaner is changed to a brush-cleaning type so as to ensure reliability of cleaning performance for spherical toner.

The laser scanning optical system 20 is a known system equipped with a laser diode, a polygon mirror and an fθ optical element, and its control section receives print data classified into C(cyan), M(magenta), Y(yellow) and Bk(black) from a host computer. The laser scanning optical system 20 outputs print data for the respective colors successively as laser beams, thereby scanning and exposing the photoconductive drum 10. Thus, electrostatic latent images for the respective colors are successively formed on the photoconductive drum 10.

The full-color developing device 30 is integrally provided with four developing devices 31Y, 31M, 31C and 31Bk separated for housing the non-magnetic toners Y, M, C and Bk respectively, and is allowed to rotate clockwise on a supporting shaft 81 as a supporting point. Each developing device has a developing sleeve 32 and a toner regulating blade 34. Toner, which is fed by the rotation of the developing sleeve 32, is charged when it is allowed to pass through a contact section (gap) between the blade 34 and the developing sleeve 32.

With respect to the installation positions of the developing devices housing the respective toners, or yellow toner, magenta toner, cyan toner and black toner, these positions are dependent on purposes of copying processes, that is, whether the purpose of the full-color image-forming apparatus is to copy line and graphic images such as characters or to copy images having gradations in respective colors such as photographic images. For example, in the case of copying of line and graphic images such as characters, a kind of toner having no gloss properties (luster) is used as black toner, and in this case, when the black toner layer is formed as the uppermost layer on a full-color copied image, inconsistency appears thereon; therefore, the black toner is preferably attached to the developing device so as not to form the black toner layer as the uppermost layer on a full-color copied image. It is most preferable to attach the black toner so that the black toner layer is formed as the lowermost layer on copied images, that is, so that, in the primary transfer process, the black toner layer is formed as the uppermost layer on the intermediate transfer member. Therefore, the yellow toner, magenta toner, and cyan toner (color toners) are attached to the developing device arbitrarily so that in the primary transfer process, each of the layers is formed as any of the first through third layers in the order of formation thereof.

The intermediate transfer belt 40 is mounted over support rollers 41 and 42 and tension rollers 43 and 44 in an endless from, and is rotationally driven in the arrow b direction in synchronism with the photoconductive drum 10. A protrusion (not shown) is placed on the side of the intermediate transfer belt 40, and a micro-switch 45 detects the protrusion so that the image-forming processes, such as exposure, developing and transferring, are controlled. The intermediate transfer belt 40 is pressed by a primary transfer roller 46 that is freely rotatable so as to come into contact with the photoconductive drum 10. This contact section forms a primary transfer section $T_1$. Moreover, the intermediate transfer belt 40 comes into contact with a secondary transfer roller 47 that is freely rotatable at its portion supported by the support roller 42. This contact portion forms a secondary transfer section $T_2$.

A cleaner 50 is installed in a space between the developing device 30 and the intermediate transfer belt 40. The cleaner 50 has a blade 51 for removing residual toner from the intermediate transfer belt 40. This blade 51 and the secondary transfer roller 47 are detachably attached to the intermediate transfer belt 40.

The paper-feed section 60 is constituted by a paper-feed tray 61 that is freely opened on the front side of the image-forming apparatus main body 1, a paper-feed roller 62 and a timing roller 63. Recording sheets S are stacked on the paper-feed tray 61, and fed to the right in the Figure one sheet by one sheet in accordance with the rotation of the paper-feed roller 62, and then transported to the secondary transfer section in synchronism with an image formed on the intermediate transfer belt 40 by the timing roller 63. A horizontal transport path 65 for recording sheets is constituted by an air-suction belt 66, etc. with the paper-feed section being included therein, and a vertical transport path 71 having transport rollers 72, 73 and 74 extends from the fixing device 70. The recording sheets S are discharged onto the upper surface of the image-forming apparatus main body 1 from this vertical transport path 71.

Next, an explanation will be given of the printing process of the full-color image-forming apparatus.

When a printing process is started, the photoconductive drum 10 and the intermediate transfer belt 40 are rotationally driven at the same peripheral velocity, and the photoconductive drum 10 is charged to a predetermined electric potential by the charging brush 11.

Successively, exposure for a cyan image is carried out by the laser scanning optical system 20 so that an electrostatic latent image of the cyan image is formed on the photoconductive drum 10. This electrostatic latent image is directly developed by the developing device 31C, and the toner image is transferred onto the intermediate transfer belt 40 at the primary transfer section. Immediately after the completion of the primary transferring process, switching is made to the developing device 31M in the developing section D, and successively, exposure, developing and primary transferring processes are carried out for a magenta image. Switching is further made to the developing device 31Y, and exposure, developing and primary transferring processes are carried out for a yellow image. Switching is further made to the developing device 30 Bk, and exposure, developing and primary transferring processes are carried out for a black image. Thus, the toner images are superimposed one by one on the intermediate transfer belt 40 for the respective primary transferring processes 1.

When the final primary transferring process is completed, a recording sheet S is sent to the secondary transfer section, and a full-color toner image, formed on the intermediate transfer belt 40, is transferred onto the recording sheet S. Upon completion of this secondary transferring process, the recording sheet S is transported to a belt-type contact-heating fixing device 70 where the full-color toner image is fixed onto the recording sheet S; then, the recording sheet S is discharged onto the upper surface of the printer main body.

The full-color toner of the present invention may be effectively applied to the developing device which is operated based on the mono-component developing system wherein the toner is charged by allowing the toner to pass through the contact section between the toner regulating blade and the developing sleeve as described above, or based on the two-component developing system in which the toner is charged by friction with carriers. In general, since the stress imposed on the toner particle is greater in the mono-component developing system than in the two-component developing system, toners to be used in the mono-component system need to have a superior anti-stress properties, as compared with those used in the two-component developing system. With respect to the developing method, the toner of the present invention may be applied to both of the contact development method and non-contact developing method.

Referring to the following examples, an explanation will be given of the present invention in more detail.

EXAMPLES

Production Examples of Polyester Resins A

To a four-necked flask equipped with a thermometer, a stainless stirring stick, a dropping-type condenser and a nitrogen gas inlet tube were loaded polyoxypropylene(2,2)-2,2-bis(4-hydroxyphenyl)propane (PO), polyoxyethylene(2,0)- 2,2-bis(4-hydroxyphenyl)propane (EO) and telephthalic acid (TPA), which were adjusted to a mole ratio of 4:6:9, together with a polymerization initiator (dibutyltinoxide). This flask was put on a mantle heater. The ingredients were heated while being stirred under a nitrogen gas flow to react. The progress of the reaction was followed by measuring its acid value. At the time of reaching a predetermined acid value, the reaction was finished. The contents were cooled to room temperature. Thus, a polyester resin was obtained. The polyester resin obtained was coarsely pulverized into not more than 1 mm, and used in producing toners which will be described later. Polyester resin A thus obtained had a softening point (Tm) of 110.3° C., a glass transition point (Tg) of 68.5° C., an acid value of 3.3 KOHmg/g, a hydroxide value of 28.1 KOHmg/g, a number-average molecular weight (Mn) of 3,300, and a ratio of weight-average molecular weight (Mw)/number-average molecular weight (Mn) of 4.2.

Production Examples of Polyester Resins B and C

Resins B and C were obtained by carrying out the same processes as the production example of polyester resin A, except that the alcohol component and the acid component were changed to have molecular ratios as shown in Table 1. FA represents fumaric acid and TMA represents trimellitic acid.

TABLE 1

| Polyester | Alcohol component | | | Acid component | | | | | Tg | Tm | Acid value | Hydroxide value |
|---|---|---|---|---|---|---|---|---|---|---|---|---|
| resin | PO | EO | GL | FA | TPA | TMA | Mn | Mw/Mn | (° C.) | (° C.) | (KoHmg/g) | (KoHmg/g) |
| A | 4.0 | 6.0 | — | — | 9.0 | — | 3,300 | 4.2 | 68.5 | 110.3 | 3.3 | 28.1 |
| B | 5.0 | 5.0 | — | 5.0 | 4.0 | — | 3,800 | 3.0 | 68.3 | 102.8 | 3.8 | 28.7 |
| C | 3.0 | 7.0 | — | — | 7.0 | 2.0 | 2,800 | 2.3 | 59.5 | 101.8 | 1.3 | 60.4 |

Preparation of Pigment Master Batch

With respect to pigments used in the preparation of the following full-color toners, a thermoplastic resin used in each Example, and C.I. Pigment Yellow 180 (made by Crarient D.), C.I. Pigment Blue 15-3 (made by Dainippon Ink Kagaku K.K.) or C.I. Pigment Red 184 (made by Dainippon Ink Kagaku K.K.) were loaded into a pressure kneader at a weight ratio of 7:3, and kneaded at 120° C. for one hour. After cooling, the kneaded materials were coarsely pulverized by a hammer mill to give pigment master batches of yellow, cyan and magenta having a pigment content of 30 wt %.

Production Examples of Full-Color Toners

Production Examples Y-1 and Y-2

To 90.7 parts by weight of polyester resin A obtained in the production example of resin were added 13.3 parts by weight of the yellow master batch, 2.0 parts by weight of a zinc complex of salicylic acid (E-84; Orient Kagaku Kogyo K.K.) serving as a charge-control agent and 2 part by weight of oxidized type low molecular weight polypropylene (100TS; Sanyo Kasei Kogyo K.K.: softening point 140° C., acid value 3.5). The mixture was sufficiently mixed in Henschel mixer, and then melted and kneaded by a twin screw extruding kneader (PCM-30; made by Ikegai Tekkou K.K.) whose discharging section was detached, and then cooled. The kneaded materials thus obtained was pressed and extended to a thickness of 2 mm by a cooling press roller, and cooled off by a cooling belt, and then roughly pulverized by a feather mill. The roughly pulverized materials were pulverized by a mechanical pulverizer (KTM: made by Kawasaki Jyukogyo K.K.) to an average particle size of 10 to 12 $\mu$m, and further pulverized and coarsely classified to an average particle size of 6.8 $\mu$m by Jet mill (IDS: made by Nippon Pneumatic Kogyo K.K.), and then finely classified by a rotor-type classifier (Teeplex classifier Type: 100 ATP; made by Hosokawa Micron K.K.), with the result that yellow toner particles (Y-1) having the following measurements were obtained: 7.1 $\mu$m in weight-average particle size ($d_{50}$); 0.1 weight % of particles having not less two times ($2d_{50}$) the weight-average particle size ($d_{50}$); and 3.2% by number of particles having not more than ⅓ ($d_{50}/3$) the weight-average particle size. The toner particles (Y-1) had an average degree of roundness of 0.943 and a standard deviation of the degree of roundness of 0.039.

To 100 parts by weight of the toner particles (Y-1) were added 0.5 part by weight of hydrophobic silica (TS-500: made by Cabosil K.K., BET specific surface area 225 $m^2/g$, pH 6.0) and 1.0 part by weight of hydrophobic silica (AEROSIL 90G (made by Nippon Aerosil K.K.) subjected to a modifying treatment by hexamethylenedisilazane; BET specific surface area 65 $m^2/g$, pH 6.0, degree of hydrophobicity 96%) (#90 HMDS). The resultant mixture was mixed by Henschel mixer (peripheral speed 40 m/sec, for 60 seconds), and then subjected to a surface-modifying treatment by heat under the following conditions by an instantaneous heating-device having a structure as shown in FIG. 1. Thus, yellow toner particles (Y-2) were obtained.

Conditions of Surface-Modifying Treatment

Heating-Treatment Device Condition 1

Developer-supplying section; Table feeder+vibration feeder

Dispersing nozzle; Four (Symmetric layout with 90 degrees respectively to all circumference)

Ejecting angle; 30 degrees

Amount of hot air; 800 L/min

Amount of dispersing air; 55 L/min

Amount of suction air; −1200 L/min

Dispersion density; 100 g/m$^3$

Processing temperature; 250° C.

Residence time; 0.5 second

Temperature of cooling air; 15° C.

Temperature of cooling water; 10° C.

Hydrophobic silica fine particles having a BET specific surface area of 170 m$^2$/g (R-974; made by Nippon Aerosil K.K.) (0.5 g) and 0.5 g of fine particles of strontium titanate having a BET specific surface area of 9 m$^2$/g were added to the above toner particles, mixed at 40 m/sec of peripheral speed for 3 minutes by Henschel Mixer, and sieved through sieve-opening 106 $\mu$m. Thus, yellow toner (Y-1) and (Y-2) were obtained.

Examples of Production Y-3 Through Y-5

The same method and compositions as example of production for toner Y-2 were carried out except that the temperature conditions of the heating-treatment were respectively changed to 150° C., 200° C. and 300° C. Thus, yellow toners (Y-3 through Y-5) were obtained.

Examples of Production C-1 to 5 and M-1 to 5

The same methods and compositions as examples of production for toners Y-1 to 5 were carried out except that the pigment master batch was changed to those of cyan and magenta pigments. Thus, toners C-1 to 5 and M-1 to 5 were obtained.

Example of Production Bk-1

The same method and compositions as example of production for toner Y-1 were carried out except that 100 parts by weight of polyester resin A was used and that the pigment master batch was changed to 4 parts by weight of carbon black (Mogul L; made by Cabot K.K.). Thus, toner Bk-1 was obtained.

Example of Production Bk-2

The same method and compositions as example of production for toner Y-2 were carried out except that 100 parts by weight of polyester resin A was used, the pigment master batch was changed to 4 parts by weight of carbon black (Mogul L; made by Cabot K.K.) and that the temperature condition of the heating-treatment was changed to 250° C. Thus, toner Bk-2 was obtained.

Examples of Production Bk-3 to 5

The same method and compositions as example of production for toner Bk-2 were carried out except that the temperature conditions of the heating-treatment were respectively changed to 150° C., 200° C. and 300° C. Thus, toners (Bk-3 to 5) were obtained.

Example of Production Y-6

The same method and compositions as example of production for toners Y-2 were carried out except that polyester resin was changed to a mixture of polyester resin C with resin D at a ratio of 20:80. Thus, toner Y-6 was obtained.

Examples of Production C-6 and M-6

The same methods and compositions as example of production for toner Y-6 were carried out except that the pigment master batches were respectively changed to those of cyan and magenta pigments. Thus, toners C-6 and M-6 were obtained.

Example of Production Bk-6

The same method and compositions as example of production for toner Y-6 were carried out except that 20 parts by weight of polyester resin B and 80 parts by weight of polyester resin C were used and that the pigment master batch was changed to 4 parts by weight of carbon black (Mogul L; made by Cabot K.K.). Thus, toner Bk-6 was obtained.

Example of Production Y-7

The same method and compositions as example of production for toner Y-2 were carried out except that 0.5 part by weight of hydrophobic silica (TS-500: made by Cabosil K.K.) and 0.5 part by weight of hydrophobic silica (AEROSIL 90G (made by Nippon Aerosil K.K.) subjected to a modifying treatment with hexamethylenedisilazane; BET specific surface area 65 m$^2$/g, degree of hydrophobicity 96%) (#90 HMDS) were added before the heating-treatment. Thus, toner particles Y-7 were obtained.

Hydrophobic silica fine particles having a BET specific surface area of 170 m$^2$/g (R-974; made by Nippon Aerosil K.K.) (0.5 g) and 0.5 g of fine particles of strontium titanate having a BET specific surface area of 9 m$^2$/g were added to the above toner particles, mixed at 40 m/sec of peripheral speed for 3 minutes by Henschel Mixer, and sieved through sieve-opening 106 $\mu$m. Thus, yellow toner (Y-7) was obtained.

Example of Production Y-8

To toner particles Y-7 were added and mixed 0.5 part by weight of hydrophobic silica (TS-500: made by Cabosil K.K., BET specific surface area 225 m$^2$/g) and 0.5 part by weight of strontium titanate (BET specific surface area 9 m$^2$/g) at a fluidizing treatment after the heating-treatment (post-process). Thus, toner Y-8 was obtained.

Examples of Production C-7 and M-7

The same method and compositions as example of production for toner Y-7 were carried out except that the pigment master batch was changed to those of cyan and magenta pigments. Thus, toner C-7 and M-7 were obtained.

Examples of Production C-8 and M-8

The same method and composition as example of production for toners C-7 and M-7 were carried out except that, at a fluidizing treatment (post-process) after the heat-treatment, 0.5 part by weight of hydrophobic silica (TS-500: made by Cabosil K.K., BET specific surface area 225 m$^2$/g) was used and 0.5 part by weight of strontium titanate (BET specific surface area 9 m$^2$/g) was used. Thus, toners C-8 and M-8 were obtained.

Examples of Production Bk-7 and 8

The same method and compositions as examples of production for toners Y-7 and 8 were carried out except that 100 parts by weight of polyester resin A were used and that the pigment master batch was changed to 4 pats by weight of carbon black (Mogul L; made by Cabot K.K.). Thus, toner Bk-7 and 8 were obtained.

Example of Production Y-9

To 89.5 parts by weight of polyester resin A were added 15 parts by weight of the master batch of yellow pigment, 1 part by weight of a boron compound represented by the following formula and 400 parts by weight of toluene.

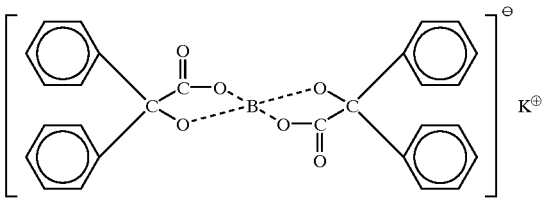

The obtained mixture was mixed, dissolved and dispersed by an ultrasonic homogenizer (output 400 $\mu$A) for 30 minutes to give a colored resin solution.

To 1,000 parts by weight of an aqueous solution containing 4% by weight of calcium phosphate hydroxide as a dispersion stabilizer was dissolved 0.1 part by weight of lauryl sodium sulfate (made by Wako Jyunyaku K.K.) so that an aqueous dispersion solution was prepared. To 100 parts by weight of this aqueous dispersion solution was dropped 50 parts by weight of the above-mentioned colored resin solution while being stirred at 4,200 rpm by a TK AUTO HOMO MIXER (made by Tokushu Kika Kogyo K.K.), with the result that droplet of the colored resin solution was suspended in the aqueous dispersion solution. This suspended liquid was left for 5 hours under the conditions of 60° C. and 100 mmHg so that toluene was removed from the droplet and colored resin particles were deposited. Then, calcium phosphate hydroxide was dissolved with concentrated sulfuric acid. The deposited particles were subjected to repeated filtration/washing processes. The filtrated particles were dried at 75° C. by a slurry drying device (Dispacoat; made by Nisshin Engineering K.K.). Thus, yellow toner particles (Y-9) were obtained.

Hydrophobic silica fine particles having a BET specific surface area of 170 $m^2/g$ (R-974; made by Nippon Aerosil K.K.) (0.5 g) and 0.5 g of fine particles of strontium titanate having a BET specific surface area of 9 $m^2/g$ were added to the above toner particles, mixed at 40 m/sec of peripheral speed for 3 minutes by Henschel Mixer, and sieved through sieve-opening 106 $\mu$m. Thus, yellow toner (Y-9) was obtained.

Examples of Production C-9 and M-9

The same methods and compositions as example of production for toner particles (Y-9) were carried out except that the pigment master batches were respectively changed from the yellow master bathes to master batches of cyan and magenta pigments. Thus, toners C-9 and M-9 were obtained.

Example of Production Y-10

To 100 parts by weight of the toner particles (Y-1) was added 1.0 part by weight of hydrophobic silica (RX-200: made by Nippon Aerosil K.K.; BET specific surface area 140 $m^2/g$). The obtained mixture was mixed by Henschel mixer (peripheral speed 40 m/sec, for 180 seconds), and then subjected to a surface-modifying treatment by heat under the following conditions by an instantaneous heating-device having a structure as shown in FIG. 1. Thus, yellow toner particles (Y-10) was obtained.

Conditions of Surface-Modifying Treatment

Heating Treatment Device Condition 2

Developer supplying section; Table feeder

Dispersing nozzle; Two (Symmetric layout with respect to all circumference)

Ejecting angle; 45 degrees

Amount of hot air; 620 L/min

Amount of dispersing air; 68 L/min

Amount of suction air; −900 L/min

Dispersion density; 150 $g/m^3$

Processing temperature; 250° C.

Residence time; 0.5 second

Temperature of cooling air; 30° C.

Temperature of cooling water; 20° C.

Hydrophobic silica fine particles having a BET specific surface area of 170 $m^2/g$ (R-974; made by Nippon Aerosil K.K.) (0.5 g) and 0.5 g of fine particles of strontium titanate having a BET specific surface area of 9 $m^2/g$ were added to the above toner particles, mixed at 40 m/sec of peripheral speed for 3 minutes by Henschel Mixer, and sieved through sieve-opening 106 $\mu$m. Thus, yellow toner (Y-10) was obtained.

Examples of Production Y-11 Through Y-13

The same method and compositions as example of production for toner Y-10 were carried out except that the temperature conditions of the heating-treatment were respectively changed to 150° C., 200° C. and 300° C. Thus, yellow toners (Y-11 through Y-13) were obtained.

Examples of Production C-10 to 13 and M-10 to 13

The same methods and compositions as examples of production for toners Y-10 to 13 were carried out except that the pigment master batch was changed to those of cyan and magenta pigments. Thus, toners C-10 to 13 and M-10 to 13 were obtained.

Examples of Production Bk-10 to 13

The same method and compositions as example of production for toner Bk-2 were carried out except that, at a fluidizing treatment (preprocess) before the heating-treatment, 1.0 part by weight of hydrophobic silica (RX-200: made by Nippon Aerosil K.K.; BET specific surface area 140 $m^2/g$) was added and that the same heating-treatment conditions as examples of production for toners Y-10 to 13 were applied. Thus, toner Bk-10 to 13 were obtained.

Example of Production Bk-9

The same method and compositions as example of production for toner Y-9 were carried out except that 100 parts by weight of polyester resin A was used and that the pigment master batch was changed to 4 parts by weight of carbon black (Mogul L; made by Cabot K.K.). Thus, toner Bk-9 was obtained.

Example of Production Y-14

To toner particles Y-1 were added and mixed 1.2 parts by weight of hydrophobic silica (RX200: made by Nippon Aerosil K.K., BET specific surface area 140 $m^2/g$) were added, and mixed by Henschel Mixer (at 40 m/sec of peripheral speed for 180 seconds). Then, the surface-modifying process was carried out by heat under the same conditions as those of Example of production Y-2 to give yellow toner particles Y-14.

Hydrophobic silica fine particles having a BET specific surface area of 225 $m^2/g$ (TS-500; made by Cabosil K.K.) (0.2 part by weight), 0.5 part by weight of hydrophobic silica fine particles having a BET specific surface area of 65 $m^2/g$ (AEROSIL90G (made by Nippon Aerosil K.K.) treated with hexamethyldisilazane) and 0.5 part by weight of fine particles of strontium titanate having a BET specific surface area of 9 $m^2/g$ were added to the above toner particles, mixed at 40 m/sec of peripheral speed for 3 minutes by Henschel Mixer, and sieved through sieve-opening 106 $\mu$m. Thus, yellow toner (Y-14) was obtained.

Examples of Production C-14 and M-14

The same methods and compositions as example of production for toner Y-14 were carried out except that the pigment master batches were respectively changed to master batches of cyan and magenta pigments. Thus, toners C-14 and magenta M-14 were obtained.

Example of Production Bk-14

The same method and compositions as example of production for toner Y-14 were carried out except that 100 parts by weight of polyester resin A was used and that the pigment master batch was changed to 4 parts by weight of carbon black (Mogul L; made by Cabot K.K.). Thus, toner Bk-14 was obtained.

With respect to the toners obtained as described above, the following measurements are listed in Tables 2 through 5: Preprocess conditions (kinds of inorganic fine particles and the amount of addition thereof (parts by weight)), heating-treatment device conditions, heating-treatment temperatures (° C.), post-process conditions (kinds of inorganic fine particles and the amount of addition thereof (parts by weight)), toner weight-average particle size ($d_{50}$) ($\mu$m), content of particles having not less than two times the weight-average particle size (>$2d_{50}$ (wt %)), content of particles having not more than ⅓ the weight-average particle size (<$d_{50}/3$ (number %), average degree of roundness, standard deviation of the degree of roundness (SD), toner-surface shape characteristics ($D/d_{50}$), true density ($\rho$), BET specific surface area (S) ($m^2/g$) of toner, and adhesive stress ($g/cm^2$).

The average particle size and its distribution were measured by Coulter Multisizer II (made by Coulter Counter K.K.) with an aperture tube diameter of 50 $\mu$m.

With respect to the average degree of roundness and the SD value, measurements were carried out by a flow-type particle image analyzer (FPIA-2000; made by Toa Iyoudenshi K.K.) in an aqueous dispersion system.

TABLE 2

| | Toner | Pre-treatment TS500/#90 HMDS | Heating treatment device condition | Heating treatment temperature | Post-treatment R974/ strontium titanate |
|---|---|---|---|---|---|
| Comparative example | Y-1 | — | — | — | 0.5/0.5 |
| Example | Y-2 | 0.5/1.0 | 1 | 250 | 0.5/0.5 |
| Comparative example | Y-3 | 0.5/1.0 | 1 | 150 | 0.5/0.5 |
| Example | Y-4 | 0.5/1.0 | 1 | 200 | 0.5/0.5 |
| Example | Y-5 | 0.5/1.0 | 1 | 300 | 0.5/0.5 |
| Exampte | Y-6 | 0.5/1.0 | 1 | 250 | 0.5/0.5 |
| Example | Y-7 | 0.5/0.5 | 1 | 250 | 0.5/0.5 |
| Example | Y-8 | 0.5/0.5 | 1 | 250 | TS500/strontium titanate 0.5/0.5 |
| Comparative example | Y-9 | | Emulsion granulation | | 0.5/0.5 |
| Comparative example | Y-10 | RX200 = 1.0 | 2 | 250 | 0.5/0.5 |
| Comparative example | Y-11 | RX200 = 1.0 | 2 | 150 | 0.5/0.5 |
| Comparative example | Y-12 | RX200 = 1.0 | 2 | 200 | 0.5/0.5 |
| Comparative example | Y-13 | RX200 = 1.0 | 2 | 300 | 0.5/0.5 |
| Example | Y-14 | RX200 = 1.2 | 1 | 250 | TS500/#90HMDS/ strontium titanate = 0.2/0.5/0.5 |

| | Degree of roundness | | | | | | | | |
|---|---|---|---|---|---|---|---|---|---|
| | Average degree of roundness | Standard deviation SD | $d_{50}$ $\mu$m | >$2d_{50}$ (weight %) | <$d_{50}/3$ (number %) | Specific surface area | $\pi$ | $D/d_{50}$ | Adhesive stress |
| Comparative example | 0.943 | 0.039 | 7.1 | 0.1 | 3.2 | 2.11 | 1.1 | 0.36 | 14.3 |
| Example | 0.981 | 0.026 | 7.1 | 0.1 | 2.8 | 1.41 | 1.1 | 0.54 | 5.1 |
| Comparative example | 0.945 | 0.037 | 7.1 | 0.1 | 3.1 | 1.98 | 1.1 | 0.39 | 7.5 |
| Example | 0.961 | 0.034 | 7.1 | 0.1 | 2.9 | 1.47 | 1.1 | 0.52 | 5.4 |
| Example | 0.990 | 0.018 | 7.2 | 0.1 | 2.7 | 1.32 | 1.1 | 0.57 | 5.0 |
| Exampte | 0.980 | 0.028 | 7.2 | 0.1 | 2.6 | 1.44 | 1.1 | 0.53 | 5.3 |
| Example | 0.980 | 0.027 | 7.1 | 0.1 | 2.7 | 1.41 | 1.1 | 0.54 | 5.6 |
| Example | 0.980 | 0.027 | 7.1 | 0.1 | 2.7 | 1.69 | 1.1 | 0.45 | 5.6 |
| Comparative example | 0.980 | 0.034 | 7.2 | 0.3 | 4.1 | 2.15 | 1.1 | 0.35 | 7.3 |
| Comparative example | 0.961 | 0.044 | 7.8 | 0.7 | 2.8 | 1.37 | 1.1 | 0.51 | 8.0 |
| Comparative example | 0.943 | 0.038 | 7.1 | 0.2 | 3.2 | 2.22 | 1.1 | 0.35 | 11.8 |
| Comparative example | 0.957 | 0.037 | 7.4 | 0.4 | 3.1 | 1.65 | 1.1 | 0.45 | 10.2 |
| Comparative example | 0.972 | 0.046 | 8.4 | 1.6 | 2.8 | 1.21 | 1.1 | 0.54 | 7.8 |
| Example | 0.976 | 0.038 | 7.4 | 0.4 | 3.1 | 1.79 | 1.1 | 0.41 | 5.9 |

TABLE 3

| | Toner | Pre-treatment TS500/#90 HMDS | Heating treatment device condition | Heating treatment temperature | Post-treatment R974/ strontium titanate |
|---|---|---|---|---|---|
| Comparative example | M-1 | — | — | — | 0.5/0.5 |
| Example | M-2 | 0.5/1.0 | 1 | 250 | 0.5/0.5 |
| Comparative example | M-3 | 0.5/1.0 | 1 | 150 | 0.5/0.5 |
| Example | M-4 | 0.5/1.0 | 1 | 200 | 0.5/0.5 |
| Example | M-5 | 0.5/1.0 | 1 | 300 | 0.5/0.5 |
| Example | M-6 | 0.5/1.0 | 1 | 250 | 0.5/0.5 |
| Example | M-7 | 0.5/0.5 | 1 | 250 | 0.5/0.5 |
| Example | M-8 | 0.5/0.5 | 1 | 250 | TS500/strontium titanate 0.5/0.5 |
| Comparative example | M-9 | | Emulsion granulation | | 0.5/0.5 |
| Comparative example | M-10 | RX200 = 1.0 | 2 | 250 | 0.5/0.5 |
| Comparative example | M-1I | RX200 = 1.0 | 2 | 150 | 0.5/0.5 |
| Comparative example | M-12 | RX200 = 1.0 | 2 | 200 | 0.5/0.5 |
| Comparative example | M-13 | RX200 = 1.0 | 2 | 300 | 0.5/0.5 |
| Example | M-14 | RX200 = 1.2 | 1 | 250 | TS500/#90HMDS/ strontium titanate = 0.2/0.5/0.5 |

| | Degree of roundness | | | | | | | | |
|---|---|---|---|---|---|---|---|---|---|
| | Average degree of roundness | Standard deviation SD | $d_{50}$ $\mu$m | $>2d_{50}$ (weight %) | $<d_{50}/3$ (number %) | Specific surface area | $\pi$ | $D/d_{50}$ | Adhesive stress |
| Comparative example | 0.943 | 0.039 | 7.1 | 0.1 | 3.2 | 2.11 | 1.1 | 0.36 | 14.3 |
| Example | 0.981 | 0.026 | 7.1 | 0.1 | 2.8 | 1.41 | 1.1 | 0.54 | 5.1 |
| Comparative example | 0.945 | 0.037 | 7.1 | 0.1 | 3.1 | 1.97 | 1.1 | 0.39 | 7.5 |
| Example | 0.961 | 0.034 | 7.1 | 0.1 | 2.9 | 1.46 | 1.1 | 0.52 | 5.4 |
| Example | 0.990 | 0.018 | 7.2 | 0.1 | 2.7 | 1.32 | 1.1 | 0.57 | 5.0 |
| Example | 0.980 | 0.028 | 7.2 | 0.1 | 2.6 | 1.45 | 1.1 | 0.53 | 5.3 |
| Example | 0.980 | 0.027 | 7.1 | 0.1 | 2.7 | 1.41 | 1.1 | 0.54 | 5.6 |
| Example | 0.980 | 0.027 | 7.1 | 0.1 | 2.7 | 1.69 | 1.1 | 0.45 | 5.6 |
| Comparative example | 0.980 | 0.034 | 7.2 | 0.3 | 4.1 | 2.15 | 1.1 | 0.35 | 7.3 |
| Comparative example | 0.962 | 0.045 | 7.8 | 0.7 | 2.8 | 1.37 | 1.1 | 0.51 | 8.0 |
| Comparative example | 0.943 | 0.038 | 7.1 | 0.2 | 3.2 | 2.22 | 1.1 | 0.35 | 11.8 |
| Comparative example | 0.957 | 0.037 | 7.4 | 0.4 | 3 1 | 1.66 | 1.1 | 0.45 | 10.2 |
| Comparative example | 0.972 | 0.046 | 8.4 | 1.6 | 2.8 | 1.21 | 1.1 | 0.54 | 7.8 |
| Example | 0.976 | 0.038 | 7.4 | 0.4 | 3.1 | 1.79 | 1.1 | 0.41 | 5.9 |

TABLE 4

| | Toner | Pre-treatment TS500/#90 HMDS | Heating treatment device condition | Heating treatment temperature | Post-treatment R974/ strontium titanate |
|---|---|---|---|---|---|
| Comparative example | C-1 | — | — | — | 0.5/0.5 |
| Example | C-2 | 0.5/1.0 | 1 | 250 | 0.5/0.5 |
| Comparative example | C-3 | 0.5/1.0 | 1 | 150 | 0.5/0.5 |
| Example | C-4 | 0.5/1.0 | I | 200 | 0.5/0.5 |
| Example | C-5 | 0.5/1.0 | 1 | 300 | 0.5/0.5 |
| Example | C-6 | 0.5/1.0 | 1 | 250 | 0.5/0.5 |
| Example | C-7 | 0.5/0.5 | 1 | 250 | 0.5/0.5 |
| Example | C-8 | 0.5/0.5 | 1 | 250 | TS500/strontium titanate 0.5/0.5 |
| Comparative example | C-9 | | Emulsion granulation | | 0.5/0.5 |
| Comparative | C-10 | RX200 = 1.0 | 2 | 250 | 0.5/0.5 |

TABLE 4-continued

| | | | | | |
|---|---|---|---|---|---|
| example | | | | | |
| Comparative example | C-11 | RX200 = 1.0 | 2 | 150 | 0.5/0.5 |
| Comparative example | C-12 | RX200 = 1.0 | 2 | 200 | 0.5/0.5 |
| Comparative example | C-13 | RX200 = 1.0 | 2 | 300 | 0.5/0.5 |
| Example | C-14 | RX200 = 1.2 | 1 | 250 | TS500/#90HMDS/ strontium titanate = 0.2/0.5/0.5 |

| | Degree of roundness | | | | | | | | |
|---|---|---|---|---|---|---|---|---|---|
| | Average degree of roundness | Standard deviation SD | $d_{50}$ $\mu$m | $>2d_{50}$ (weight %) | $<d_{50}/3$ (number %) | Specific surface area | $\pi$ | $D/d_{50}$ | Adhesive stress |
| Comparative example | 0.943 | 0.039 | 7.1 | 0.1 | 3.2 | 2.10 | 1.1 | 0.36 | 14.3 |
| Example | 0.981 | 0.026 | 7.1 | 0.1 | 2.8 | 1.42 | 1.1 | 0.54 | 5.1 |
| Comparative example | 0.945 | 0.037 | 7.1 | 0.1 | 3.1 | 1.98 | 1.1 | 0.39 | 7.5 |
| Example | 0.961 | 0.034 | 7.1 | 0.1 | 2.9 | 1.46 | 1.1 | 0.52 | 5.4 |
| Example | 0.991 | 0.018 | 7.2 | 0.1 | 2.7 | 1.31 | 1.1 | 0.57 | 5.0 |
| Example | 0.981 | 0.027 | 7.2 | 0.1 | 2.6 | 1.45 | 1.1 | 0.53 | 5.3 |
| Example | 0.980 | 0.027 | 7.1 | 0.1 | 2.7 | 1.41 | 1.1 | 0.54 | 5.6 |
| Example | 0.980 | 0.027 | 7.1 | 0.1 | 2.7 | 1.69 | 1.1 | 0.45 | 5.6 |
| Comparative example | 0.980 | 0.034 | 7.2 | 0.3 | 4.1 | 2.16 | 1.1 | 0.35 | 7.3 |
| Comparative example | 0.960 | 0.044 | 7.8 | 0.7 | 2.8 | 1.37 | 1.1 | 0.51 | 8.0 |
| Comparative example | 0.943 | 0.038 | 7.1 | 0.2 | 3.2 | 2.21 | 1.1 | 0.35 | 11.8 |
| Comparative example | 0.957 | 0.037 | 7.4 | 0.4 | 3.1 | 1.65 | 1.1 | 0.45 | 10.2 |
| Comparative example | 0.972 | 0.046 | 8.4 | 1.6 | 2.8 | 1.20 | 1.1 | 0.54 | 7.8 |
| Example | 0.976 | 0.038 | 7.4 | 0.4 | 3.1 | 1.79 | 1.1 | 0.41 | 5.9 |

TABLE 5

| | Toner | Pre-treatment TS500/#90 HMDS | Heating treatment device condition | Heating treatment temperature | Post-treatment R974/ strontium titanate |
|---|---|---|---|---|---|
| Comparative example | Bk-1 | — | — | — | 0.5/0.5 |
| Example | Bk-2 | 0.5/1.0 | 1 | 250 | 0.5/0.5 |
| Comparative example | Bk-3 | 0.5/1.0 | 1 | 150 | 0.5/0.5 |
| Example | Bk-4 | 0.5/1.0 | 1 | 200 | 0.5/0.5 |
| Example | Bk-5 | 0.5/1.0 | 1 | 300 | 0.5/0.5 |
| Example | Bk-6 | 0.5/1.0 | 1 | 250 | 0.5/0.5 |
| Example | Bk-7 | 0.5/0.5 | 1 | 250 | 0.5/0.5 |
| Example | Bk-8 | 0.5/0.5 | 1 | 250 | TS500/strontium titanate 0.5/0.5 |
| Comparative example | Bk-9 | | Emulsion granulation | | 0.5/0.5 |
| Comparative example | Bk-10 | RX200 = 1.0 | 2 | 250 | 0.5/0.5 |
| Comparative example | Bk-11 | RX200 = 1.0 | 2 | 150 | 0.5/0.5 |
| Comparative example | Bk-12 | RX200 = 1.0 | 2 | 200 | 0.5/0.5 |
| Comparative example | Bk-13 | RX200 = 1.0 | 2 | 300 | 0.5/0.5 |
| Example | Bk-14 | RX200 = 1.2 | 1 | 250 | TS500/#90HMDS/ strontium titanate = 0.2/0.5/0.5 |

| | Degree of roundness | | | | | | | | |
|---|---|---|---|---|---|---|---|---|---|
| | Average degree of roundness | Standard deviation SD | $d_{50}$ $\mu$m | $>2d_{50}$ (weight %) | $<d_{50}/3$ (number %) | Specific surface area | $\pi$ | $D/d_{50}$ | Adhesive stress |
| Comparative example | 0.942 | 0.040 | 7.1 | 0.1 | 3.3 | 2.10 | 1.1 | 0.37 | 14.3 |

TABLE 5-continued

| | | | | | | | | | |
|---|---|---|---|---|---|---|---|---|---|
| Example | 0.983 | 0.026 | 7.0 | 0.1 | 3.0 | 1.39 | 1.1 | 0.54 | 5.1 |
| Comparative example | 0.947 | 0.036 | 7.1 | 0.1 | 3.3 | 1.97 | 1.1 | 0.39 | 7.5 |
| Example | 0.963 | 0.036 | 7.0 | 0.1 | 2.8 | 1.45 | 1.1 | 0.54 | 5.4 |
| Example | 0.991 | 0.017 | 7.1 | 0.1 | 2.6 | 1.32 | 1.1 | 0.58 | 5.0 |
| Example | 0.980 | 0.028 | 7.2 | 0.1 | 2.6 | 1.44 | 1.1 | 0.53 | 5.3 |
| Example | 0.980 | 0.028 | 7.1 | 0.1 | 3.0 | 1.39 | 1.1 | 0.55 | 5.6 |
| Example | 0.980 | 0.027 | 7.1 | 0.1 | 2.7 | 1.67 | 1.1 | 0.46 | 5.6 |
| Comparative example | 0.981 | 0.037 | 7.2 | 0.4 | 4.5 | 2.16 | 1.1 | 0.35 | 7.3 |
| Comparative example | 0.97 | 0.042 | 8.1 | 1.1 | 4.0 | 1.38 | 1.1 | 0.49 | 8.0 |
| Comparative example | 0.943 | 0.038 | 7.1 | 0.2 | 3.2 | 2.22 | 1.1 | 0.35 | 11.8 |
| Comparative example | 0.957 | 0.037 | 7.4 | 0.4 | 3.1 | 1.65 | 1.1 | 0.45 | 10.2 |
| Comparative example | 0.972 | 0.046 | 8.4 | 1.6 | 2.8 | 1.21 | 1.1 | 0.54 | 7.8 |
| Example | 0.976 | 0.038 | 7.4 | 0.4 | 3.1 | 1.79 | 1.1 | 0.41 | 5.9 |

By using a full-color printer (Color Page Pro™ PS: made by Minolta K.K.) with an increased system speed of 140 mm/sec which has a structure as shown in FIG. 3, various evaluation tests were carried out in combination with color toners shown in Table 6. The evaluation was made under high-temperature, high-humidity environments (HH environments) (30° C., 85%) on image losses and transferring efficiency. The evaluation was made after copy of 10 sheets (initial) and after copy of 5,000 sheets (endurance). The evaluation method is shown as follows. The four kinds of toners were loaded in four developing devices so as to form layers in the order of Y, M, C and Bk on the intermediate transfer belt upward from the bottom.

With respect to image losses, full-color images (general pattern) were copied by means of four-color superpose printing. The copied images were evaluated by visual observation and ranked as follows. Not ordinary paper, but rough paper was used as copying paper.

○: No image loss occurred on copied images;

Δ: Slight image losses occurred on copied images, but no problem was raised in practical use;

×: Many image losses occurred on copied images, which caused a serious problem in practical use.

With respect to the transferring efficiency, a solid pattern of a magenta mono-color image was copied, and the efficiency was evaluated based upon a ratio of the amount of toner adhesion onto paper to the amount of toner adhesion onto the photoconductive drum during copying processes, and ranked
as follows:

○: not less than 80%;

Δ: not less than 70% to less than 80%;

×: less than 70%.

Table 6 shows the results of the above-mentioned evaluation.

TABLE 6

| | Toner | | | | Image losses in superposed colors H/H | | Transferring efficiency H/H | |
|---|---|---|---|---|---|---|---|---|
| | Y | M | C | Bk | Initial | After endurance processes | Initial | After endurance processes |
| Example 1 | Y-2 | M-2 | C-2 | Bk-2 | ○ | ○ | ○ | ○ |
| Example 2 | Y-4 | M-4 | C-4 | Bk-4 | ○ | ○ | ○ | ○ |
| Example 3 | Y-5 | M-5 | C-5 | Bk-5 | ○ | ○ | ○ | ○ |
| Example 4 | Y-7 | M-7 | C-7 | Bk-7 | ○ | ○ | ○ | ○ |
| Example 5 | Y-8 | M-8 | C-8 | Bk-8 | ○ | ○ | ○ | ○ |
| Example 6 | Y-6 | M-6 | C-6 | Bk-6 | ○ | ○ | ○ | ○ |
| Example 7 | Y-14 | M-14 | C-14 | Bk-14 | ○ | ○ | ○ | Δ |
| Comparative example 1 | Y-1 | M-1 | C-1 | Bk-1 | X | — | X | — |
| Comparative example 2 | Y-3 | M-3 | C-3 | Bk-3 | Δ | X | X | X |
| Comparative example 3 | Y-9 | M-9 | C-9 | Bk-9 | ○ | X | ○ | X |
| Comparative example 4 | Y-10 | M-10 | C-10 | Bk-10 | X | — | X | — |
| Comparative example 5 | Y-11 | M-11 | C-11 | Bk-11 | X | — | X | — |
| Comparative example 6 | Y-12 | M-12 | C-12 | Bk-12 | X | — | X | — |
| Comparative example 7 | Y-13 | M-13 | C-13 | Bk-13 | X | — | X | — |

The present invention makes it possible to provide a non-magnetic toner for developing electrostatic latent images with a superior transferring properties, which can form good images not only at low-speed, but also at high-speed. Since the toner of the present invention ensures desired toner fluidity and moving properties to the transferred member and the transferring properties are remarkably improved. Therefore, it is possible to provide good image free from image noise such as image losses, etc., and also to easily meet demands for high-speed image-formation. Since the electrification-build-up properties are improved and a sharp distribution of quantity of charge is achieved, it is possible to reduce noise such as fogs due to insufficient electrical charge, and consequently to improve the image quality. Further, it is possible to eliminate a phenomenon such as selective developing (a phenomenon in which toner having a specific particle size and quantity of electrical charge is first consumed selectively), and consequently to ensure stable toner-quality even during an endurance printing process. Furthermore, as the use of the toner of the present invention makes it possible to improve efficiency in moving properties (developing and transferring properties), etc., a range of machine-setting conditions are widened.

What is claimed is:

1. A production method of non-magnetic toner, comprising the steps of;

mixing a binder resin and a colorant;

melting and kneading the above obtained mixture;

pulverizing the kneaded material;

classifying the pulverized materials to give a colored resin particles;

mixing inorganic fine particles with the colored resin particles;

heat-treating the above obtained mixture to give toner particles in which the colored resin particles make spherical and the inorganic fine particles are fixed on the surface of the colored resin particles; and mixing a post-treatment agent with the toner particles to give a toner.

2. The production method of claim 1, in which the inorganic fine particles have a BET specific surface area of 100 to 350 $m^2/g$.

3. The production method of claim 1, in which the inorganic fine particles have a BET specific surface area of 50 to 100 $m^2/g$.

4. The production method of claim 1, in which the inorganic fine particles comprises a first inorganic fine particles having a BET specific surface area of 100 to 350 $m^2/g$ and a second inorganic fine particles having a BET specific surface area of 50 to 100 $m^2/g$, the BET specific surface area of the first inorganic fine particles is at least 30 $m^2/g$ larger than that of the second inorganic fine particles.

5. The production method of claim 1, in which the toner particles are admixed externally with post-treatment agent having a BET specific surface area of 1 to 350 $m^2/g$.

6. The production method of claim 1, in which the post-treatment agent comprises a first post-treatment agent having a BET specific surface area of 100 to 350 $m^2/g$ and a second post-treatment agent having a BET specific surface area of 1 to 100 $m^2/g$, the BET specific surface area of the first post-treatment agent is at least 30 $m^2/g$ larger than that of the second post-treatment agent.

7. The production method of claim 1, in which the binder resin has a glass transition point of 50 to 75° C., a softening point of 80 to 120° C., a number-average molecular weight of 2,500 to 30,000 and a ratio of weight-average molecular weight/number-average molecular weight of 2 to 20.

8. The production method of claim 7, in which the binder resin is a polyester resin having an acid value of 2 to 50 KOHmg/g.

9. A production method of non-magnetic toner, comprising the steps of;

mixing a binder resin and a colorant;

melting and kneading the above obtained mixture;

pulverizing the kneaded material;

classifying the pulverized materials to give a colored resin particles;

mixing inorganic fine particles with the colored resin particles; and heat-treating the above obtained mixture to give toner particles having an average degree of roundness of not less than 0.960, a standard deviating of degree of roundness of not more than 0.040, a value of $D/d_{50}$ of not less than 0.40 and an adhesive stress of 6 $g/cm^2$ or less under a compression of 1 $kg/cm^2$, in which $D=6/(p \cdot S)$ (p is a true density of toner particles ($g/cm^3$) and S is a BET specific surface area of toner particles ($m^2/g$)); $d_{50}$ is an average weight particle size of toner particles.

10. The production method of claim 9, in which the average degree of roundness is not less than 0.965.

11. The production method of claim 9, in which the standard deviation of degree of roundness is not more than 0.035.

12. The production method of claim 9, in which the $D/d_{50}$ is between 0.40 and 0.80.

13. The production method of claim 9, in which the adhesives stress is between 2.0 and 5.5 $g/cm^2$.

14. The production method of claim 9, comprising the step of mixing a post-treatment agent with the toner particles, the post-treatment agent having a BET specific surface area of 100 to 350 $m^2/g$.

15. The production method of claim 9, comprising the step of mixing a post-treatment agent with the toner particles, the post-treatment agent having a BET specific surface area of 1 to 100 $m^2/g$.

16. The production method of claim 9, comprising the step of mixing a post-treatment agent with the toner particles, the post-treatment agent comprising a first post-treatment agent having the BET specific surface area of 100 to 350 $m^2/g$ and a second post-treatment agent having the BET specific surface area of 1 to 100 $m^2/g$, the BET specific surface area of the first post-treatment agent being at least 30 $m^2/g$ larger than that of the second post-treatment agent.

17. The production method of claim 9, in which the inorganic fine particles have a BET specific surface area of 100 to 350 $m^2/g$.

18. The production method of claim 9, in which the inorganic fine particles have a BET specific surface area of 50 to 100 $m^2/g$.

19. The production method of claim 9, in which the inorganic fine particles comprise first inorganic fine particles having a BET specific surface area of 100 to 350 $m^2/g$ and second inorganic fine particles having the BET specific surface area of 50 to 100 $m^2/g$, the BET specific surface area of the first inorganic fine particles being at least 30 $m^2/g$ larger than that of the second inorganic fine particles.

20. The production method of claim 9, in which the binder resin is a polyester resin which has a glass transition point of 50 to 75° C., a softening point of 80 to 120° C., a number-average molecular weight of 2,500 to 30,000, a ratio of weight-average molecular weight/number-average molecular weight of 2 to 20 and an acid value of 2 to 50 KOHmg/g.

* * * * *